US005205739A

United States Patent [19]

Malo et al.

[11] Patent Number: 5,205,739

[45] Date of Patent: Apr. 27, 1993

[54] HIGH DENSITY PARALLEL INTERCONNECT

[75] Inventors: Cheryne Malo, Foxboro; Steven P. Marian, Plainville, both of Mass.; David W. Mendenhall, Greenville, R.I.

[73] Assignee: Augat Inc., Mansfield, Mass.

[21] Appl. No.: 863,340

[22] Filed: Apr. 2, 1992

Related U.S. Application Data

[63] Continuation-in-part of Ser. No. 435,191, Nov. 13, 1989, Pat. No. 5,102,342.

[51] Int. Cl.[5] ..... H01R 9/09

[52] U.S. Cl. ..... 439/66; 439/591

[58] Field of Search ..... 439/59-62, 439/64, 65, 66, 67, 79, 80, 77, 259, 260, 629, 630, 91, 591

[56] References Cited

U.S. PATENT DOCUMENTS

| | | | |
|---|---|---|---|
| 3,715,706 | 2/1973 | Michel et al. | 439/65 |
| 3,853,382 | 12/1974 | Lazar . | |
| 3,924,915 | 12/1975 | Conrad | 439/592 |
| 4,288,140 | 9/1981 | Griffith et al. . | |
| 4,420,203 | 12/1983 | Aug et al. . | |
| 4,517,625 | 5/1985 | Frink et al. | 361/399 |
| 4,518,210 | 5/1985 | Morrison . | |
| 4,538,866 | 9/1985 | Johnson . | |
| 4,540,227 | 9/1985 | Faraci . | |
| 4,540,228 | 9/1985 | Steele . | |
| 4,552,420 | 11/1985 | Eigenbrode . | |
| 4,585,288 | 4/1986 | Aikens | 439/629 |
| 4,597,619 | 7/1986 | Reimer . | |
| 4,629,270 | 12/1986 | Andrews, Jr. et al. . | |
| 4,693,530 | 9/1987 | Stillie et al. | 439/67 |
| 4,744,764 | 5/1988 | Rubenstein | 439/62 |
| 4,795,977 | 1/1989 | Frost et al. | 324/158 F |
| 4,838,798 | 6/1989 | Evans et al. | 439/61 |
| 4,838,801 | 6/1989 | Bertogolio | 439/66 |
| 4,869,676 | 9/1989 | Demler, Jr. et al. | 439/79 |
| 4,881,901 | 11/1989 | Mendenhall et al. | 439/65 |

FOREIGN PATENT DOCUMENTS 2154363 11/1973 France .

*Primary Examiner*—Neil Abrams

*Attorney, Agent, or Firm*—Weingarten, Schurgin, Gagnebin & Hayes

[57] ABSTRACT

A modified high density backplane (MHDB) connector is provided for electrically interconnecting high density printed circuit boards having predetermined interconnect circuitry including high density arrays of ground-/signal contact pads, discrete power pads and discrete ground pads. The MHDB connector includes one or more contact modules, a connector housing, a pcb biasing mechanism, connector end caps, a flexible film, two interactive biasing modules for each contact module, and a camming member secured to the pcb to be mated. The interactive biasing modules contact with the flexible film to provide uniform contact force distribution over the interconnect regions of the connector and provide contact rivet displacement tolerance relief. The MHDB connector provides sequenced movement of the pcb to be mated into the contact rivets to provide contact wipe and may provide for alignment of the one pcb with the MHDB connector. The end caps provide for MHDB connector sealing and localized securement of the connector to the pcb. The power contact modules may include supply and return contacts and provide the capability for reconfiguring the MHDB connector for diverse applications. A parallel interconnect embodiment effects electrical engagement between two circuit boards disposed in parallel planes.

6 Claims, 24 Drawing Sheets

HIGH DENSITY PARALLEL INTERCONNECT

This application is a continuation-in-part of U.S. patent application Ser. No. 07/435,191, filed Nov. 13, 1989, now U.S. Pat. No. 5,102,342 and which is related to U.S. Pat. No. 4,881,901, issued Nov. 21, 1989, entitled HIGH DENSITY BACKPLANE CONNECTOR.

FIELD OF THE INVENTION

The present invention relates generally to connectors for electrically interconnecting printed circuit boards, and more particularly to a modified high density backplane connector which provides high density interconnection capability, which is readily adaptable to different interconnect configurations, which provides uniform interconnect force over the interconnect regions, and which provides sequenced mating.

BACKGROUND OF THE INVENTION

The effectiveness and performance of printed circuit boards are continually being upgraded by the use of more complex solid state circuit technology, the use of higher frequency operating signals to improve circuit response times and by increasing the circuit density of the boards. The upgrade in printed circuit board technology, in turn, has placed more stringent requirements upon the design of electrical connectors. The need exists for electrical connectors having increased input-/output densities and decreased contact interconnect spacing, improved electrical performance, high mechanical integrity, improved reliability and greater flexibility. Additionally, the electrical connectors should be adapted for surface mount technology and for effecting printed circuit board mating with low insertion forces.

Prior art electrical connectors for electrically interconnecting printed circuit boards have traditionally been fabricated using stamped and formed contacts and molded dielectrical material. These prior art electrical connectors have been limited to contact interconnect spacing on the order of 40 contact interconnects per linear inch. In addition, prior art contact interconnect matrices have been formed as distributed pluralities of signal, ground and power contact interconnects, typically in a ratio of 6:3:1, respectively.

For example, if a particular application requires 300 signal contact interconnects, the contact interconnect matrix must be formed to have 500 contact interconnects since 150 ground contact interconnects and 50 power contact interconnects are required. With a contact interconnect density of 40 contact interconnects/linear inch, a single row of 500 distributed signal, ground and power contact interconnects would occupy 12.50 linear inches of board space, thus limiting the input/output density of the electrical connector.

To satisfy the input/output densities required by present day circuit board technology, contact interconnect spacing on the order of 80 contact interconnects/linear inch is required. While electrical connectors are available which have contact interconnect spacing on the order of 80 contact interconnects per linear inch, these electrical connectors utilize interconnect matrices having distributed signal, ground and power contact interconnects. Thus, even electrical connectors having contact interconnect spacing on the order of 80 contact interconnects per linear inch provide only a limited increase in input/output density. For example, a single row of 500 distributed signal, ground and power contact interconnects would occupy 6.25 linear inches of board space.

Higher frequency signals are increasingly being utilized with printed circuit boards to improve the response time of the circuits. The use of higher frequency signals, however, presents additional design constraints upon designers of electrical connectors. The frequency response curve for low to middle frequency signals is illustrated in FIG. 1A wherein $t_r$ represents the rise time of the signal, $t_s$ represents the settling time of the signal, $t_{ss}$ represents the steady state or operational condition of the signal, and $t_f$ represents the fall time of the signal. To increase circuit performance, $t_r$ and $t_s$ should be minimized to the extent practicable.

One means of improving circuit performance is by reducing the $t_r$ of the signal. Higher frequency signals improve the response time of a circuit by significantly reducing $t_r$. A typical signal response curve for a high frequency signal is illustrated in FIG. 1B. The high frequency signal has a $t_r$ approximately one order of magnitude lower than a low frequency signal, i.e., 0.3 nanoseconds versus 5 nanoseconds. As will be apparent from an examination of FIG. 1B, however, higher frequency signals may have a relatively longer $t_s$ due to impedance mismatches and/or discontinuities in the signal conducting paths. Therefore, a prime concern in designing electrical connectors is to ensure signal path integrity in the electrical connection by matching impedances between the electrical connector and the mated printed circuit boards.

A further problem area for electrical connectors is the effect of contamination and/or oxidation on contact interconnects. Concomitant with an increase in input-/output density of contact interconnects is the decrease in size of the contact interconnects. The reduction in size of the contact interconnects aggravates the detrimental effects of contamination and/or oxidation of the contact interconnects such as increased contacting resistances and distortion of electrical signals. Therefore, an effective electrical connector should have the capability of providing a wiping action between the contact interconnects of the printed circuit boards and the electrical connector.

The use of flexible film having preformed contact interconnects and interconnecting circuit traces is known in the art. Electrical connectors must be capable of effecting repetitive connections/disconnections between printed circuit boards. Repetitive connections/-disconnections cause repetitive wiping action of the contact interconnects which may cause an undesirable degradation in the mechanical and electrical characteristics of the contact interconnects and/or the integrity of the signal paths of the electrical connector and/or printed circuit boards.

Finally, electrical connectors require some mechanical means for camming to provide the capability for printed circuit board mating with low insertion mating forces and to effect the wiping action between the contact interconnects. Ideally, the camming means should be a simple mechanical configuration and easily operated, thereby reducing the costs and time attributed to the manufacture and/or assemblage of the electrical connector. Representative camming mechanisms are shown in U.S. Pat. Nos. 4,629,270, 4,606,594 and 4,517,625. An examination of these patents reveals that the camming mechanisms disclosed therein are relatively complex mechanical devices requiring the fabrication and assemblage of a multitude of components.

While these camming mechanisms may be functionally effective to provide a wiping action between contact interconnects, such camming mechanisms are relatively bothersome to fabricate and assemble. In addition, complex camming mechanisms significantly reduce the reliability and flexibility of the electrical connector.

SUMMARY OF THE INVENTION

The present invention is directed to a modified high density backplane (MHDB) connector of modular construction which may be readily reconfigured for diverse applications. The MHDB connector provides high density contact interconnect spacing, maintains signal path integrity, significantly reduces or eliminates signal settling time by providing matched impedance between printed circuit boards and provides a sequenced mating to effect a wiping action between the contact elements of the connector and pcb to be mated.

The MHDB connector provides uniform contact distribution force over the interconnect regions and provides contact displacement tolerance relief. The MHDB connector includes an integral camming mechanism which is simple to fabricate and operate. The MHDB connector greatly reduces or eliminates mechanical wear on the interconnect matrix.

The MHDB connector includes one or more contact modules, a connector housing, a pcb biasing mechanism, connector end caps, a flexible film, two interactive biasing modules for each contact module, and a camming member secured to the pcb to be mated. The MHDB connector may also include one or more power contact modules and one or more intermediate and/or end-positioned mounting blocks.

The contact module holds the arrays of interconnect contact rivets, provides connector to pcb alignment and provides the capability to readily reconfigure the MHDB connector for different applications. Reconfiguration of the MHDB connector for different applications is readily effected by adding or removing contact modules.

The contact module includes means for holding first and second arrays of contact rivets in free floating relation. The first and second arrays of contact rivets are orientated to interconnect to corresponding signal/ground contact pads of the respective pcbs. The contact module also includes means for aligning the MHDB connector with a pcb.

The connector housing is configured for assemblage with the contact modules and may be readily formed to any required length, depending upon the application. The connector housing includes a complementary camming structure to provide sequenced mating between one pcb and the MHDB connector. The connector housing and the contact modules in combination provide mounting chambers for the interactive biasing modules The biasing mechanism is configured for assemblage with the contact modules and may be readily formed to any required length, depending upon the application. The biasing mechanism mechanically engages the pcb mated to the MHDB connector to ensure a positive electrical interconnection between the pcb interconnect circuitry and the corresponding contact elements of the contact modules.

The power contact modules include a clip configured for assemblage with the contact modules and a resilient power contact. The power contact modules may provide both supply and return contacts, and may be added or removed from the MHDB connector as required, depending upon the particular application and the number of contact modules.

The power contact provides electrical interconnection between discrete power pads on the respective pcbs. The power contact also resiliently interacts with the pcb to be mated to exert a biasing force thereagainst for sequenced mating of the pcb to the MHDB connector.

The connector end caps are configured for assemblage with the connector housing to seal the ends of the MHDB connector. The connector end caps may also provide a means for localized securement of the MHDB connector to the pcb. Each connector end cap may further include a resilient ground contact which provides early ground electrical interconnection between discrete ground pads on the respective pcbs. The resilient ground contacts also resiliently interact with the pcb to be mated to exert a biasing force thereagainst for sequenced mating of the pcb to the MHDB connector. The connect end caps of one embodiment include a camming linkage which coacts with the pcb to be mated to provide sequenced mating of the pcb to the MHDB connector housing.

The flexible film includes a conductive matrix for electrically interconnecting the signal/ground contact pads of the respective pcbs. The flexible film is disposed in abutting relation to the first and second arrays of contact rivets of each contact module.

First and second interactive biasing modules are disposed in abutting relation to the flexible film in opposition to the first and second arrays of contact rivets, respectively, in chambers defined by the contact module and connector housing. The interactive biasing modules provide uniform contact force distribution between the flexible film and the first and second arrays of contact rivets, respectively. The interactive biasing modules also provide displacement tolerance relief for the first and second arrays of contact rivets disposed in each contact module, respectively.

Each interactive biasing module includes a force generating spring coacting with the connector housing for providing the interconnection force to bias the flexible film against the first and second array of contact rivets of the contact module, a resilient means abutting the flexible film for providing displacement tolerance relief, and a distribution plate. The distribution plate, which abuts the resilient means and has the force generating spring secured thereto, uniformly distributes the biasing force generated by the force generating spring over the respective interconnect region.

The MHDB connector of the present invention includes a camming member secured to the pcb to be mated. The camming member is configured to coact with the connector housing during mating to provide sequenced movement of the pcb to be mated to provide contact wipe between the contact elements thereof. The camming member may also include means acting in combination with the connector housing for aligning the pcb for mating with the MHDB connector.

The MHDB connector may also include one or more mounting blocks to provide intermediate spacing/securing and/or end-positioned securement for the connector. The mounting block is configured for assemblage with the connector housing and the biasing wedge. A resilient spring may be utilized in combination with intermediate mounting blocks to coact with the pcb to be mated to exert a biasing force thereagainst for sequenced mating of the pcb with the MHDB connector. A parallel interconnect embodiment effects electrical engagement between two circuit boards disposed in parallel planes.

BRIEF DESCRIPTION OF THE DRAWINGS

A more complete understanding of the present invention and the attendant advantages and features thereof will be more readily understood by reference to the following detailed description when considered in conjunction with the accompanying drawings wherein.

DETAILED DESCRIPTION OF PREFERRED EMBODIMENTS

Figure 1A:
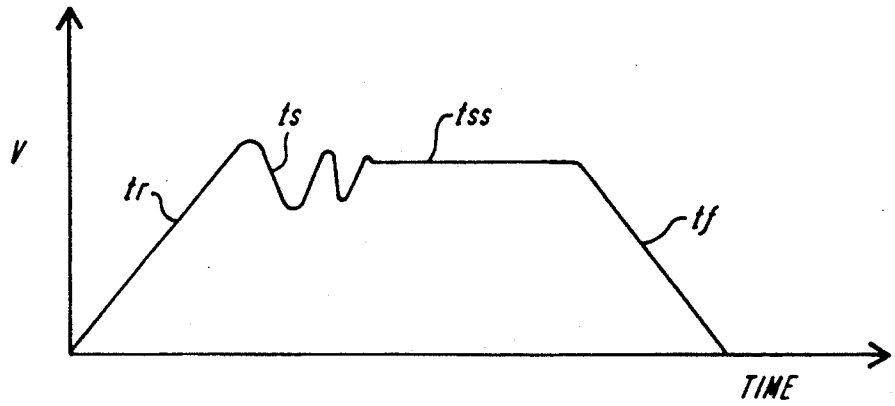
FIGS. 1A, 1B are representative signal response curves.
Figure 1B:
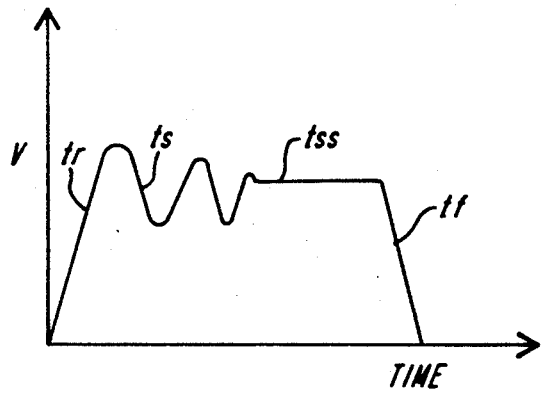
Figure 2:
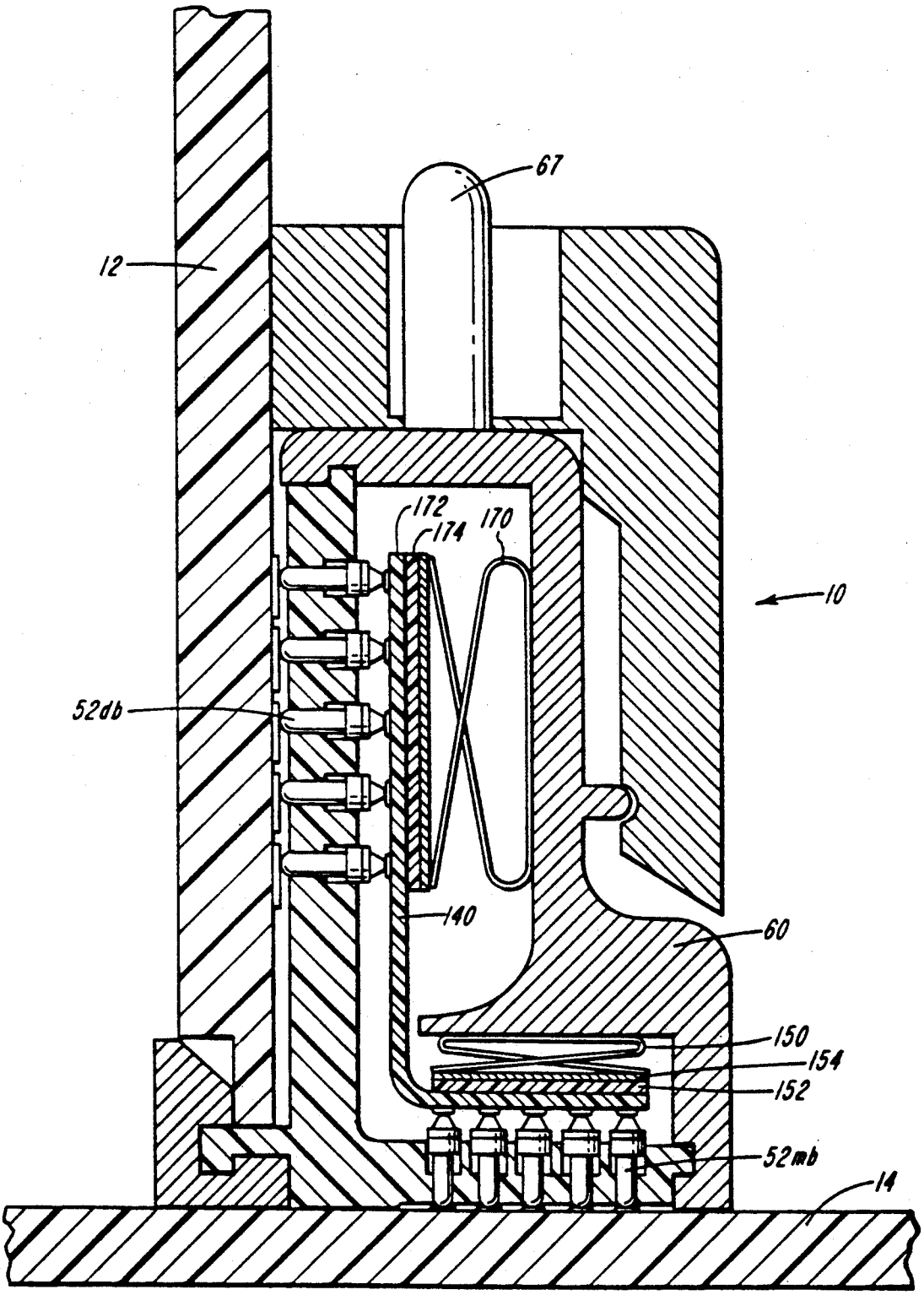
FIG. 2 is a transverse section of a high density backplane connector according to the invention.
Figure 2A:
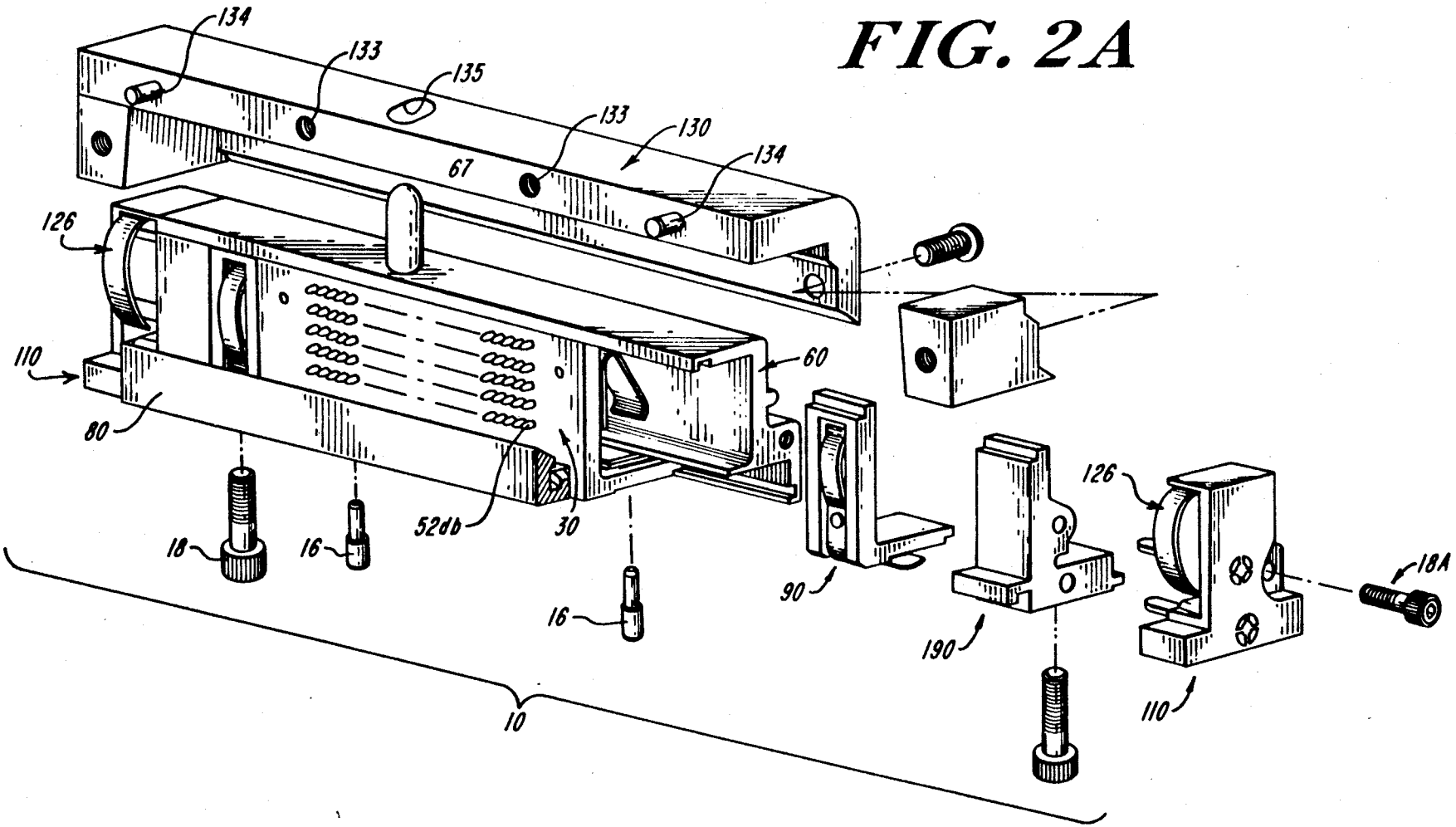
FIGS. 2A, 2B are partial, exploded perspective views of exemplary embodiments of a modified high density backplane connector according to the present invention.
Figure 2B:
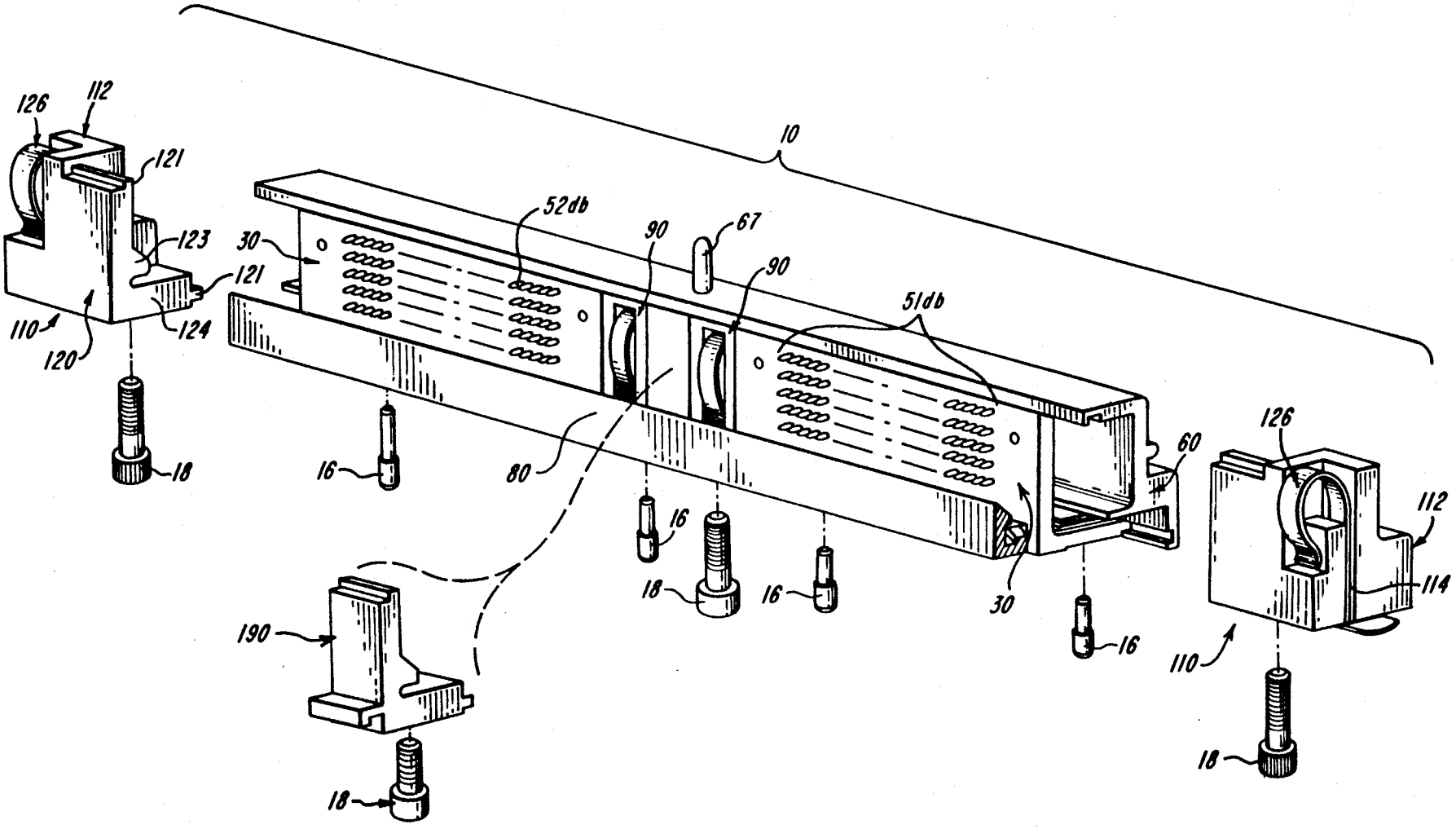

Referring now to the drawings wherein like numerals designate corresponding or similar elements throughout the several views, FIG. 2 illustrates a modified high density backplane connector 10 as assembled. The connector 10 acts to effectively interface a daughterboard 12 which is a constituent part of an electronic assembly including a motherboard 14. The construction and function of the various components of various embodiments of the connector 10 are described in detail hereinafter. There are shown in FIGS. 2A, 2B partial exploded perspectives of exemplary embodiments of a modified high density backplane (MHDB) connector 10 according to the present invention having utility for electrically interconnecting printed circuit boards such as a daughterboard 12 to a backplane or motherboard 14. The motherboard 14 and the daughterboard 12 each include interconnect circuitry for electrically interconnecting the printed circuit boards to the MHDB connector 10.

Partial plan views of representative motherboard 14 and daughterboard 12 each include interconnect circuitry for electrically interconnecting the printed circuit boards to the MHDB connector 10.

Figure 16A:
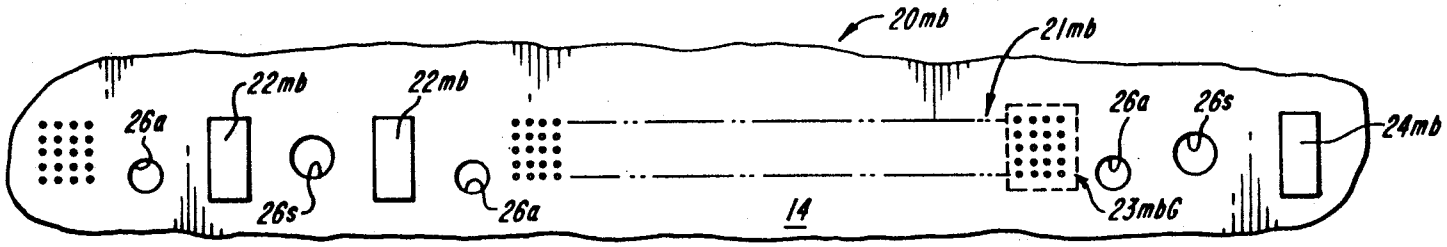
FIGS. 16A, 16B, 16C are partial and full plan views of representative motherboard interconnect circuitry, an exemplary geometric array of motherboard signal/ground contact pads and a single contact pad, respectively.
Figure 17A:
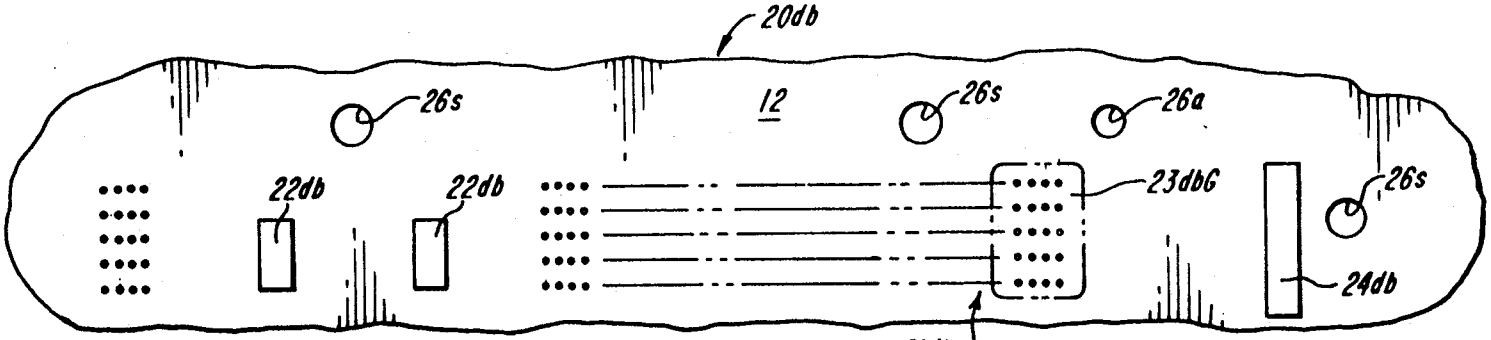
FIGS. 17A, 17B, 17C are partial and full plan views of representative daughterboard interconnect circuitry, an exemplary geometric array of daughterboard signal/ground contact pads and a single contact pad, respectively.

Partial plan views of representative motherboard and daughterboard interconnect circuitry $\mathbf{20}_{mb}$ and $\mathbf{20}_{db}$ are illustrated in FIGS. 16A, 17A. The motherboard interconnect circuitry $20_{mb}$ includes one or more geometric arrays $21_{mb}$ of signal/ground contact pads $23_{mb}$, discrete power contact pads $22_{mb}$ and discrete ground contact pads $24_{mb}$ as depicted in FIG. 16A. The daughterboard interconnect circuitry $20_{db}$ consists of complementary geometric arrays $21_{db}$, of signal/ground contact pads $23_{db}$, discrete power 39 contact pads $22_{db}$ and discrete ground contact pads $24_{db}$ as depicted in FIG. 17A.

As illustrated in FIGS. 16B, 16C, 17B, 17C, the geometric arrays $21_{mb}$ and $21_{db}$ consist of individual signal/ground contact pads $23_{mb}$ and $23_{db}$ mounted in rows and columns to form predetermined motherboard and daughterboard footprints. For the motherboard geometric array $21_{mb}$ one of the outer rows of contact pads are ground contact pads $23_{mbG}$ while for the daughterboard geometric array $21_{db}$ the top row of contact pads are ground contact pads $23_{dbG}$.

Contact pad connection means $27_{mb}$ and $27_{db}$ electrically interconnect the signal/ground contact pads $23_{mb}$ and $23_{db}$ to the motherboard and daughterboard, respectively. The motherboard 14 and daughterboard 12 have securing/alignment apertures $26_s$ and $26_a$ formed therethrough for aligning and securing the MHDB connector 10 thereto, respectively.

The MHDB connectors 10 exemplarily illustrated in FIGS. 2A, 2B include one or more contact modules 30, a connector housing 60, a daughterboard biasing wedge 80, and connector end caps 110. The MHDB connector 10 further includes a camming member 130 configured to be secured to the daughterboard 12 and to coact with the connector housing 60, a flexible film 140 interacting with elements of each contact module 30 (FIG. 10), and a motherboard interactive biasing module 150 (FIG. 11) and a daughterboard interactive biasing module 170 (FIGS. 13A, 13B) for each contact module 30. Depending upon the configuration and application, the MHDB connector 10 may also include one or more power contact modules 90 and one or more mounting blocks 190 (FIG. 15) positioned intermediate and/or adjacent the external ends of the contact modules 30.

Conversion or reconfiguration of the MHDB connector 10 for different applications is facilitated by the addition or removal of individual contact modules 30 as required. The embodiment illustrated in FIG. 2A includes a single contact module 30 having end positioned power modules 90 and mounting blocks 190. The embodiment illustrated in FIG. 2B includes two spaced-apart contact modules 30 separated by intermediately positioned power contact modules 90 and an intermediate mounting block 190.

Figure 10A:
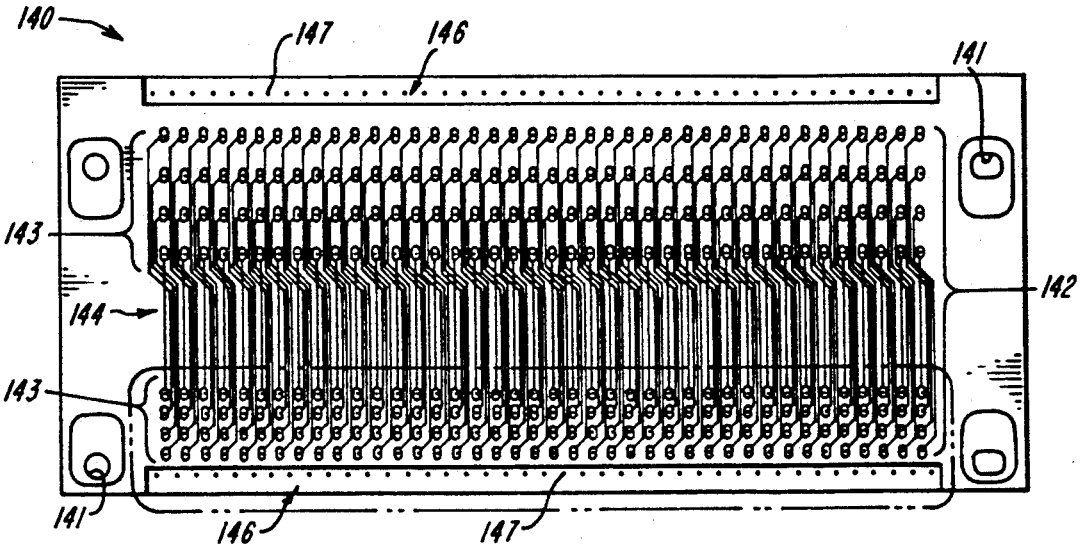
FIGS. 10A, 10B, 10C are plan views of embodiments of a flexible film according to the present invention.
Figure 10B:
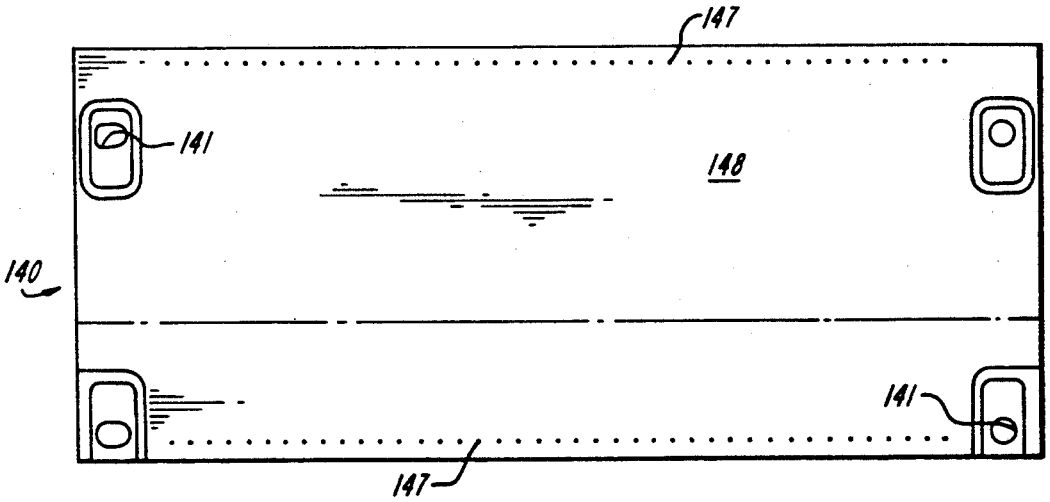

For the exemplary embodiments, referring now to FIGS. 2B, 4A, 4B, 10A and 10B, each contact module 30 includes two hundred signal/ground contact elements $52_{db}$ defining a daughterboard array $51_{db}$ and two hundred ground signal contact elements $52_{mb}$ defining a motherboard array $51_{mb}$ (FIGS. 10A, 10B). Each exemplary array is arranged in five rows of forty contact elements per row, corresponding to the geometric arrays of signal/ground contact pads of the daughterboard and the motherboard, respectively.

Accordingly, for the contact module 30 embodiments exemplarily illustrated in FIGS. 2A, 2B, the MHDB connector 10 may be incremented or decremented by two hundred signal/ground contact elements 52 by adding or removing, respectively, one or more contact modules 30. It will be appreciated that the contact module 30 may have other configurations, i.e., number of rows, contacts per row, for the array of signal/ground contact elements 52 depending upon the configuration of the interconnect circuitry of the printed circuit boards to be electrically interfaced.

The contact module 30 of the present invention provides the means to align the MHDB connector 10 on the motherboard 14 and holds the contact elements 52 that provide electrical interconnection between the signal/ground contact pads $23_{mb}$, $23_{db}$ of the motherboard 14 and the daughterboard 12 via the flexible film 140. The contact module 30 is an integral element formed from a nonconductive, high impact material, for example, plastics such a LCP (liquid crystal polymer) or glass filled epoxies such as FR-4.

Figure 3A:
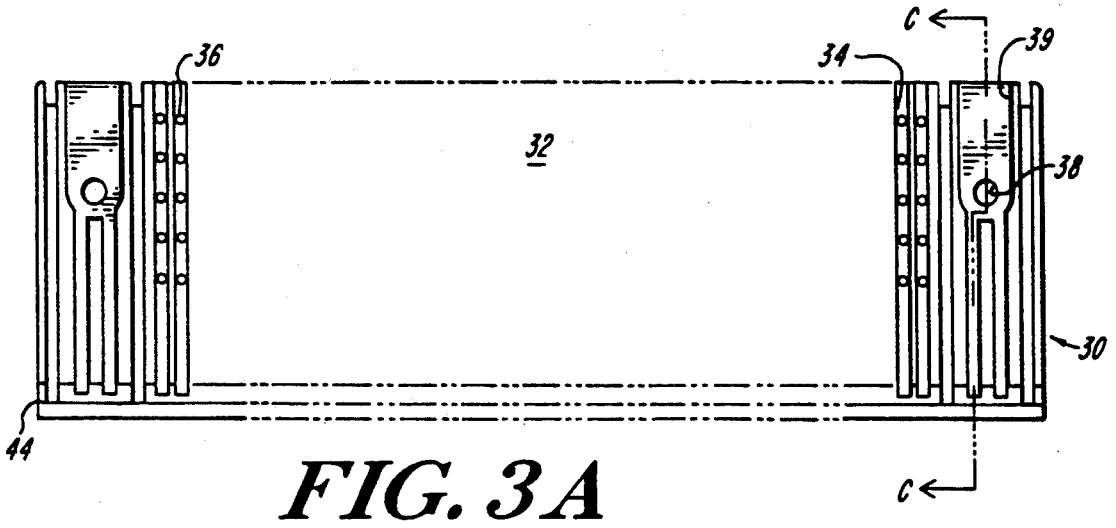
FIGS. 3A, 3B, 3C are plan and cross-sectional (along line C—C of FIG. 3A) views, respectively, of one embodiment of a contact module according to the present invention.
Figure 3B:
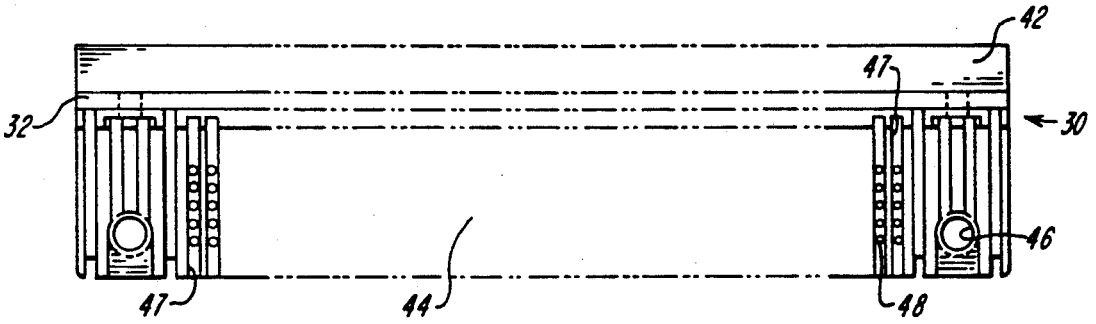
Figure 3C:
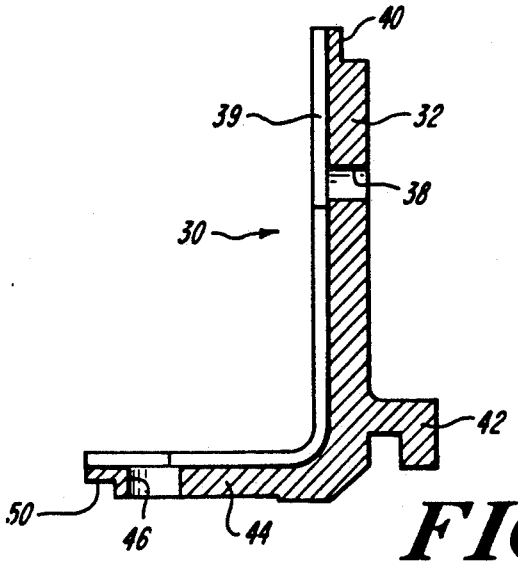
Figure 3D:
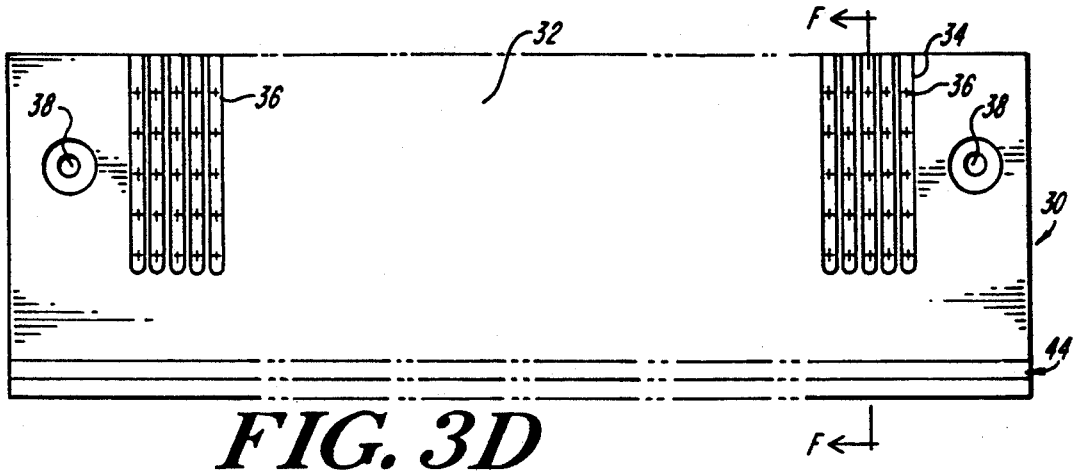
FIGS. 3D, 3E, 3F are plan and cross-sectional (along line F—F of FIG. 3D) views, respectively, of another embodiment of a contact module according to the present invention.
Figure 3E:
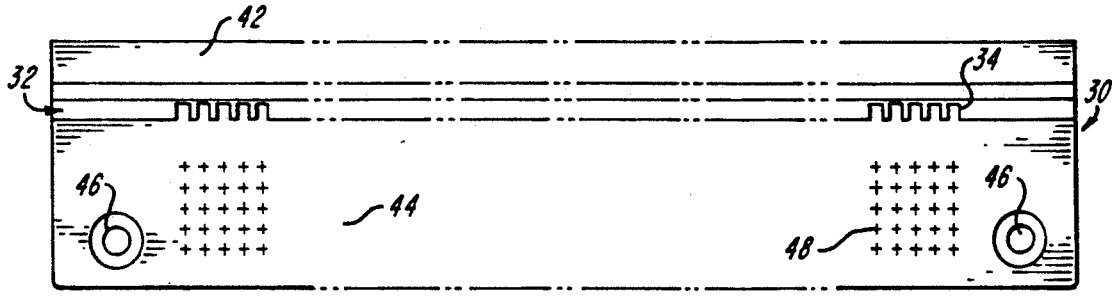
Figure 3F:
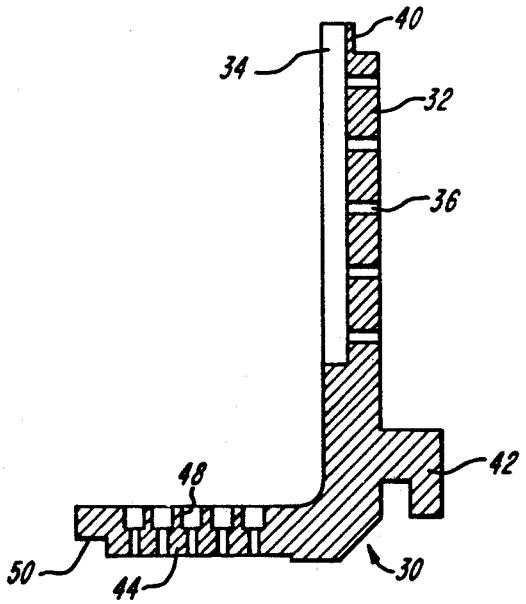

One embodiment of a contact module according to the present invention is illustrated in FIGS. 3A, 3B, 3C. Another embodiment of a contact module according to the present invention is shown in FIGS. 3D, 3E, 3F.

Referring to FIGS. 3A–3F, the integral contact module 30 includes a first planar member 32 and a second planar member 44 disposed to form a generally L-shaped configuration. The first planar member 32 has a plurality of contact channels 34 formed therein corresponding to the number of signal/ground contact pads $23_{db}$ per row in the daughterboard geometric array $21_{db}$. A plurality of contact ports 36, corresponding to the number of rows of signal/ground contact pads $23_{db}$ in the daughterboard geometric array $21_{db}$ are formed in each contact channel 34 to extend through the planar member 32.

The planar member 32 also includes mounting bores 38. The mounting bores 38 of the embodiment of FIGS. 3A, 3B, 3C are disposed in a cutaway portion 39 of the first planar member 32 while the mounting bores 38 of the embodiment of FIGS. 3D, 3E, 3F are formed through the planar member 32 in a stepped configuration. A first housing engaging shoulder 40 is formed in the free end of the planar member 32. A wedge engaging member 42 extends outwardly from the planar member 32 as illustrated in FIGS. 3C, 3F.

The second planar member 44 includes alignment bores 46 for aligning the contact module 30 for securement to the motherboard 14, and a second housing engaging shoulder 50 formed in the free end thereof. Each contact module 30 is aligned on the motherboard 14 by alignment pins 16 (See FIG. 2), which are fitted in alignment bores 46 of the planar member 44, that fit into respective alignment bores $26_a$ of the motherboard 14.

The planar member 44 of the contact module embodiment illustrated in FIGS. 3A, 3B, 3C has a plurality of contact channels 47 formed therein corresponding to the number of signal/ground contact pads $23_{mb}$ per row in the motherboard geometric array $21_{mb}$. A plurality of contact receptacles 48 are formed in each contact channel 47 to extend through the second planar member 44. For the embodiment of FIGS. 3D, 3E, 3F, the plurality of contact receptacles 48 are formed through the planar member 44 in a stepped configuration. The configuration of the contact receptacles 48 corresponds to the geometric array $21_{mb}$ of signal/ground contact pads $23_{mb}$ of the motherboard 14.

Figure 4A:
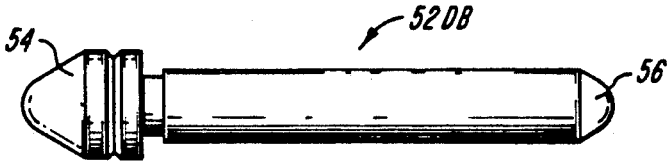
FIGS. 4A, 4B, are plan views of exemplary contact elements for the contact module embodiments of FIGS. 3A, 3B, 3C and 3D, 3E, 3F.
Figure 4B:
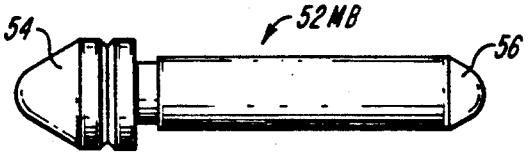

Exemplary contact elements $52_{db}$, $52_{mb}$ for the above-described contact modules 30 are depicted in FIGS. 4A, 4B, respectively. The contact elements $52_{db}$ and $52_{mb}$ may be formed as rivets having a head contact portion 54 and a tail contact portion 56. The contact rivets $52_{db}$ are configured for mounting and limited movement within corresponding contact channels 34—contact ports 3 of the first planar member 32 while the contact rivets $52_{mb}$ are configured for mounting and limited movement within the corresponding contact channels 47—contact receptacles 48 or contact receptacles 48 of the second planar member 44, i.e., the contact rivets $52_{db}$ and $52_{mb}$ are free floating. The contact rivets $52_{db}$ and $52_{mb}$ held in the first and second planar members 32, 44 form the first and second contact arrays $51_{db}$ and $51_{mb}$ respectively (see FIG. 10A), of each contact module 30. The contact rivets 52 are formed from a conductive material, e.g., a copper alloy such as phosphor bronze.

Figure 5A:
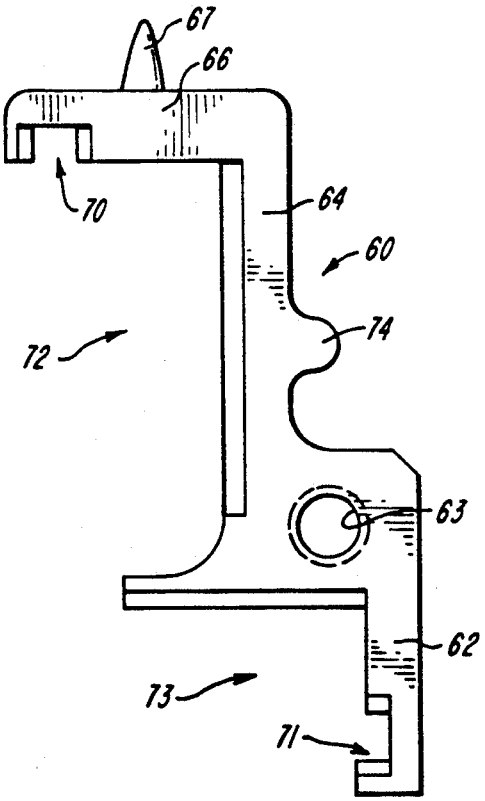
FIG. 5A is a plan view of one embodiment of a connector housing according to the present invention.
Figure 5B:
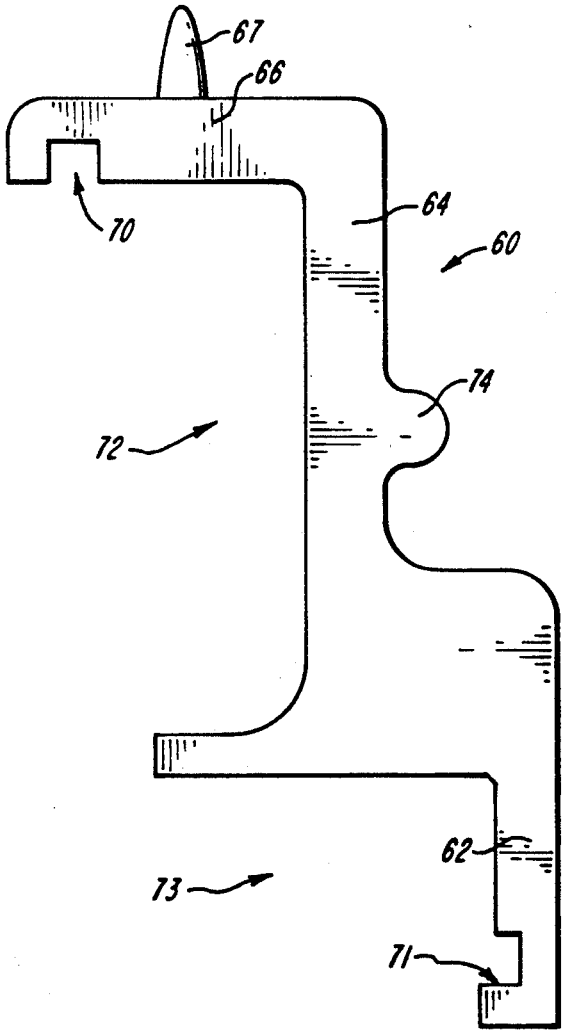
FIG. 5B is a plan view of another embodiment of a connector housing according to the present invention.
Figure 5C:
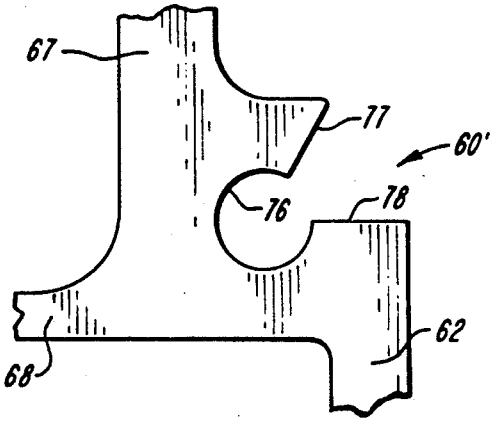
FIG. 5C is a partial plan view of an alternative embodiment based upon the configuration of the embodiment of FIG. 5B.

One embodiment of a connector housing of the MHDB connector 10 is illustrated in FIG. 5A. Another embodiment of a connector housing for the MHDB connector 10 is shown in FIG. 5B. An alternative embodiment based on the configuration of the connector housing illustrated in FIG. 5B is depicted in FIG. 5C.

The connector housing 60 is configured for assemblage with one or more contact modules 30 and is formed by conventional fabrication techniques, for example, by extrusion, as an integral unit from a material as aluminum (6061-T6) that may be finished with teflon impregnated TUFRAM. The connector housing 60 is readily formed to have any required length, the required length depending upon the number of contact modules 30 and other components, e.g., power contact modules 90 and/or intermediate and/or end positioned mounting blocks 190 comprising the MHDB connector 10. For the embodiment illustrated in FIG. 2A, the MHDB connector 10 has an overall assembled length of about 4.25 inches (about 108 mm).

The connector housing 60 includes a first sidewall 62, a second sidewall 64 generally parallel to and offset from the first sidewall 62, and a top wall 66 integrally extending from the second sidewall 64. For the connector housing embodiment of FIG. 5A, a partially threaded circular channel 63 is formed in the shoulder portion between the first and second sidewalls 62, 64.

The connector housing 60 further includes a platform member 68 extending outwardly from the shoulder portion between the first and second sidewalls 62, 64. A first module engaging channel 70 is formed in the top wall 66 and configured for engagement with the first housing engaging shoulder 40 of each contact module 30. A second module engaging channel 71 is formed in the second sidewall 62 and configured for engagement with the second housing engaging shoulder 50 of each contact module 30.

A complementary camming structure 74 is integrally formed as part of the connector housing 60 to project outwardly from the second sidewall 64. The complementary camming structure 74 is configured to interact with the camming member 130, which is secured to the daughterboard 12, during mating of the daughterboard 12 with the MHDB connector 10. An alignment member 67 may be integrally formed with and depending outwardly from the top wall 66. The alignment member 67 interacts with the camming member 130 to align the daughterboard 12 for mating with the MHDB connector 10.

With one or more contact modules 30 mounted on the motherboard 14 as described hereinabove, the connector housing 60 may be mated with individual contact modules 30 by sliding the first and second module engaging channels 70, 71 onto the first and second shoulders 40, 50, respectively, of the contact module 30. With the connector housing 60 mated with the individual contact modules 30, a first mounting chamber 72 for the flexible film 140 and the daughterboard interactive biasing module 170 (see FIG. 13B) is defined by one surface of the platform member 68, the inner surfaces of the second sidewall 64 and the top wall 66 and a portion of the inner surface of the first planar member 32 in combination. A second mounting chamber 73 for the flexible film 140 and the motherboard interactive biasing module 150 (see FIG. 11) is similarly defined by the other surface of the platform member 68, the inner surface of the first sidewall 62 and a portion of the inner surface of the first planar member 32 and the inner surface of the second planar member 44 in combination.

An alternative embodiment based upon the configuration of the connector housing 60 illustrated in FIG. 5B is shown in FIG. 5C. In addition to the structural features described in the preceding paragraphs, the connector housing 60' further includes a partial cylindrical channel 76 terminating in first and second surfaces 77, 78, respectively. A locking rod (not shown), operative in combination with the connector end caps 110, may be disposed within the partial cylindrical channel 76 to lock the connector housing 60 into final position in the MHDB connector 10 assemblage.

Figure 6A:
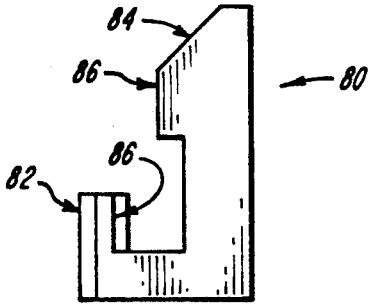
FIGS. 6A, 6B are plan views of exemplary daughterboard biasing wedges according to the present invention.
Figure 6B:
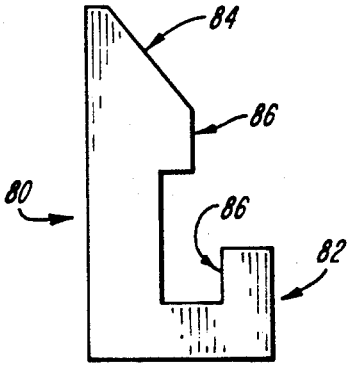

Exemplary embodiments of daughterboard biasing wedges 80 according to the present invention are depicted in FIGS. 6A, 6B. The biasing wedge 80 is formed, for example, by extrusion, as an integral unit from a material such as aluminum (6061-T6) or plastic. The biasing wedge 80 is readily formed in any convenient length, depending upon the number of contact modules 30 in the MHDB connector 10.

The biasing wedge 80 has a generally L-shaped configuration and includes a complementary contact module engaging portion 82, an insertion surface 84, and a daughterboard engaging surface 86. The biasing wedge 80 may be mated to the contact modules 30 by sliding the complementary contact module engaging portion 82 into the wedge engaging member 42 of the contact module 30. During mating of the daughterboard 12 with the MHDB connector 10, the edge of the daughterboard 12 moves along the insertion surface 84, thereby ensuring that the daughterboard 12 is properly aligned for mating.

With the daughterboard 12 mated to the MHDB connector 10, the daughterboard 12 is mechanically engaged by the opposed, spaced-apart engaging surfaces 86 of the wedge 80. This mechanical engagement prevents the daughterboard 12 from creeping or "walking" away from the MHDB connector 10. The biasing wedge 80 ensures that a positive electrical interconnection is maintained between the interconnect circuitry $20_{db}$ of the daughterboard 12 and the corresponding contact elements of the contact modules 30.

Figure 7A:
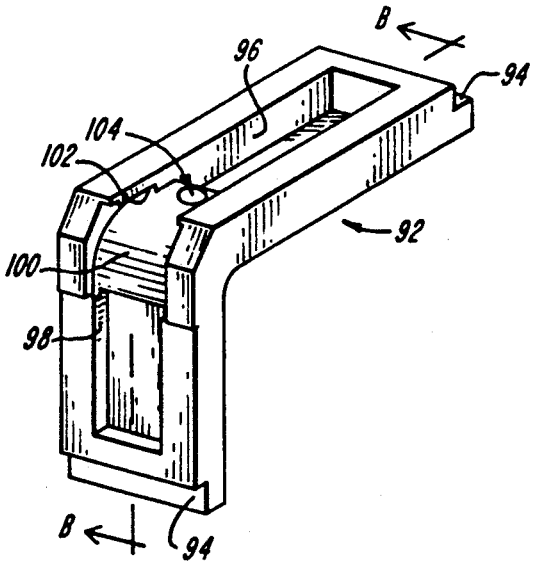
FIG. 7A is a perspective view of power contact module clip according to the present invention.
Figure 7B:
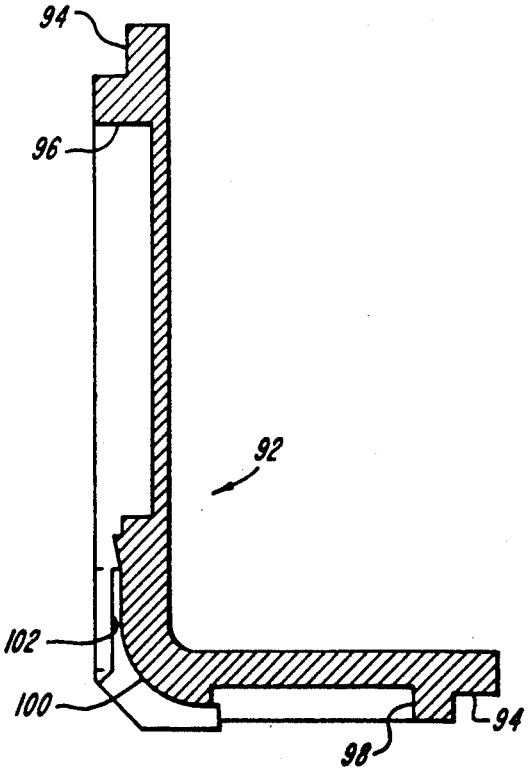
FIG. 7B is a cross-sectional view of the power contact module clip of FIG. 7A taken along line B—B.
Figure 7C:
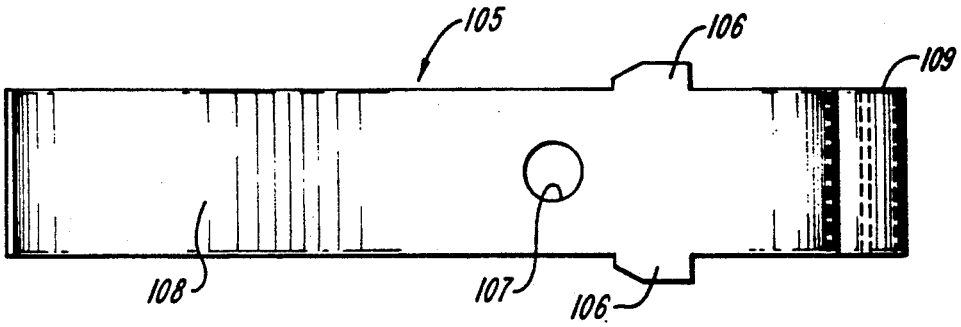
FIG. 7C is a first plan view of a power contact according to the present invention.
Figure 7D:
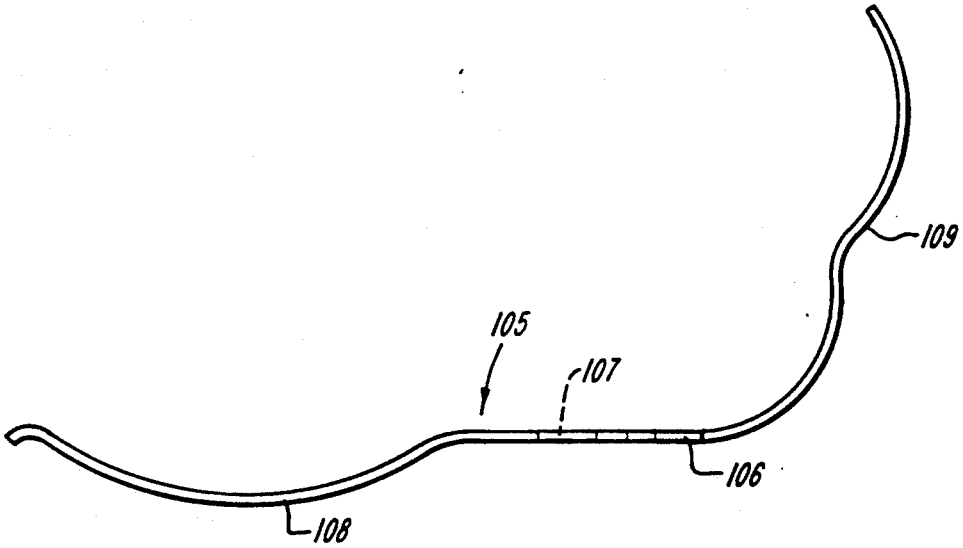
FIG. 7D is a second plan view of the power contact of FIG. 7C.

An exemplary power contact module 90 for the MHDB connector 10 of the present invention is exemplarily illustrated in FIGS. 7A–7D. The power contact module 90 includes a power contact module clip 92 (FIGS. 7A, 7B) and a resilient power contact 105 (FIGS. 7C, 7D). The power contact modules 90 may provide both supply and return contacts and can be added or removed from the MHDB connector 10 as required, depending upon the particular application and the number of contact modules 30.

The power contact module clip 92 is integrally formed from a nonconductive material such as plastic, e.g., LCP, and has a generally L-shaped configuration.

The power contact module clip 92 has housing engaging shoulders 94, 94 formed at the free ends thereof configured to mechanically engage the first and second module engaging channels 70, 71 of the connector housing 60.

The power contact module clip 92 also has first and second contact windows 96, 98 formed therein. The first and second contact windows 96, 98 are separated by a transverse member 100. Contact retention slots 102 are formed in the module clip 92 superjacent the transverse member 100. A pin 104 is formed to depend outwardly from the transverse member 100 as illustrated in FIG. 7A.

The power contact 105, as illustrated in FIGS. 7C and 7D, is formed from a conductive material such as a copper alloy, e.g., No. C172, and has a resilient configuration adapted for mating with the module clip 92. The power contact 105 includes opposed detents 106, a complementary pin hole 107, a daughterboard engaging segment 108, and a motherboard engaging segment 109.

The opposed detents 106 are configured for insertion within the contact retention slots 102 of the module clip 92. The module clip 92 and power contact 105 are positioned for assemblage in the MHDB connector 10 by inserting the pin 104 through the complementary pin hole 107.

The daughterboard engaging segment 108 is positioned in the first contact window 96 and protrudes outwardly therefrom. The daughterboard engaging segment 108 is positioned to mechanically and electrically resiliently engage a corresponding discrete power contact pad $22_{db}$ of the daughterboard geometric array $21_{db}$. The resilient interaction between the daughterboard engaging segment 108 and the corresponding discrete power contact pad $22_{db}$ exerts a biasing force against the daughterboard 12 to effect sequenced mating of the daughterboard 12 with the MHDB connector 10.

The motherboard engaging segment 109 is positioned in the second contact window 98 and protrudes outwardly therefrom. The motherboard engaging segment 109 is positioned to mechanically and electrically resiliently engage a corresponding power contact pad $22_{md}$ of the motherboard geometric array $21_{mb}$.

Various embodiments of connector end caps 110 according to the present invention are exemplarily illustrated in FIGS. 2A, 2B and shown in greater detail in FIGS. 8A–8L. The connector end caps 110 provide a means for sealing the exposed ends of the MHDB connector 10. The connector end caps 110 may also provide a means for localized securement of the MHDB connector 10 to the motherboard 14 (see embodiment of FIG. 8E). The connector end caps 110 may be integrally formed from a rigid material such as plastic, e.g., LCP, by any of the various fabrication techniques, such as molding.

Figure 8A:
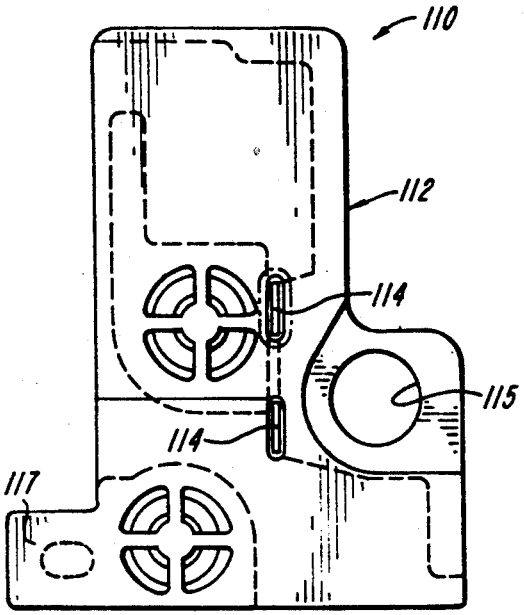
FIGS. 8A, 8B, 8C are end and side views, respectively, of one embodiment of a connector end cap member according to the present invention.
Figure 8B:
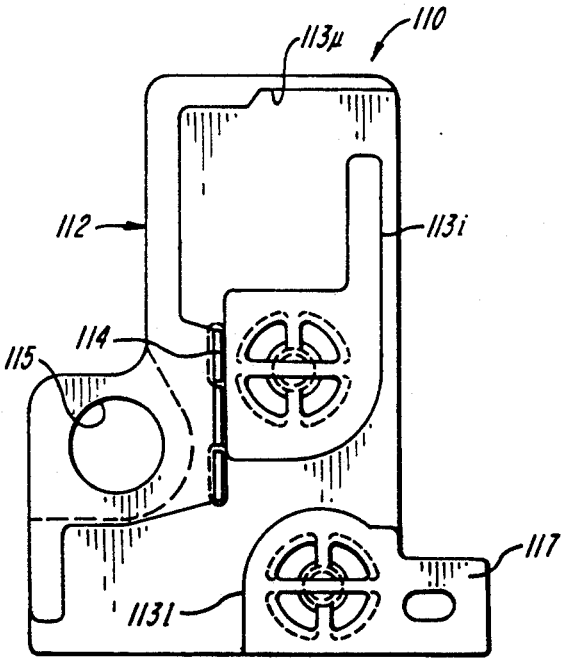
Figure 8C:
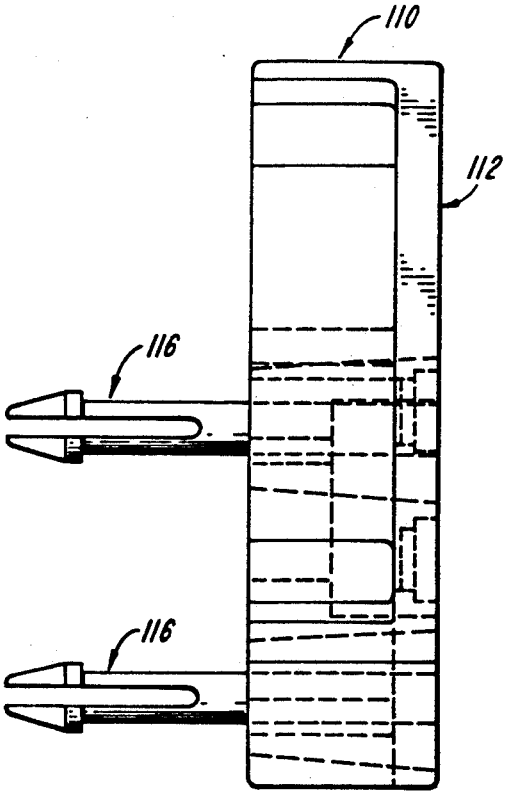

One embodiment of the connector end cap 110 is illustrated in FIGS. 8A, 8B, 8C. This particular embodiment is configured for utilization in combination with end positioned mounting blocks 190 as illustrated in FIG. 2A. The connector end cap 110 includes an end cap member 112 configured to receive an early mate resilient ground contact 126 in combination therewith. The ground contact 126 for the embodiment of FIGS. 8A–8C is illustrated in FIGS. 8I, 8J. The resilient ground contact 126, which may be formed by stamping from a conductive material such as a copper alloy, includes a motherboard engaging portion 127, a daughterboard engaging portion 128 and an end cap engaging means 129. For this particular embodiment, the end cap engaging means 129 comprises a pair of spaced-apart detents.

The end cap member 112 of this embodiment includes contact positioning portions 113, contact retention means 114, in this embodiment a pair of spaced-apart detent slots, a securement bore 115, one or more segmented engagement prongs 116 and a sealing portion 117. The resilient ground contact 126 is mounted in combination with the end cap member 112 by snap engaging the detents 129 into the contact detent slots 114 with the daughterboard engaging portion 128 of the contact 126 positioned adjacent the outer surface of the intermediate contact positioning portion $113_i$.

The segmented engagement prongs 116 are configured for snap engagement within stepped bores 197 of the abutting mounting block 190 as illustrated in FIG. 2A. Securement screws 18A are inserted through the securement bores 115 of the connector end caps 110 and threadingly engaged in the threaded circular channels 63 of the connector housing 60 during final assemblage of the MHDB connector 10. The sealing portion 117 of the end cap member 112 engages the wedge engaging member 194 of the abutting mounting block 190 to retain the contact modules 30, the daughterboard biasing wedge 80, the power contact modules 90 and the mounting blocks 190 in static fixed relation with respect to one another.

With the MHDB connector 10 secured to the motherboard 14, the motherboard engaging portions 127 of the resilient ground contacts 126 of the connector end caps 110 are biased into engagement with respective discrete ground contact pads $24_{mb}$ of the motherboard 14. During mating, the daughterboard engaging portions 128 of the resilient ground contacts 126 initially coact with the daughterboard 12 to exert biasing forces thereagainst to provide sequenced mating thereof with the MHDB connector 10. The daughterboard engaging portions 128 of the ground contacts 126 engage the daughterboard discrete ground pads $24_{db}$ during the mating sequence to provide an early ground interconnect between the motherboard 14 and the daughterboard 12.

Figure 8D:
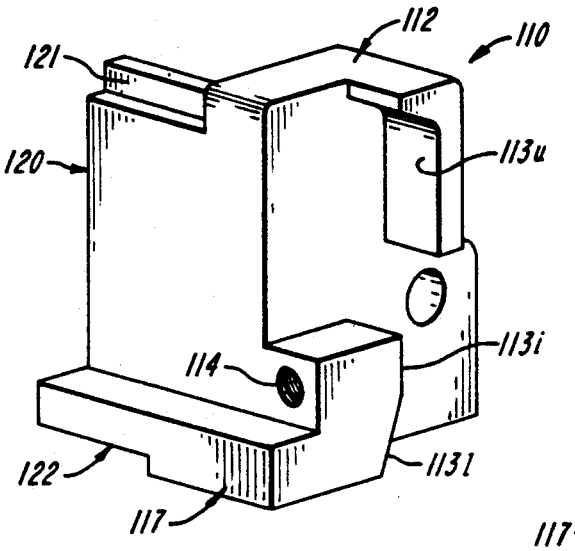
FIGS. 8D, 8E are perspective and end views of another embodiment of a connector end cap according to the present invention.
Figure 8E:
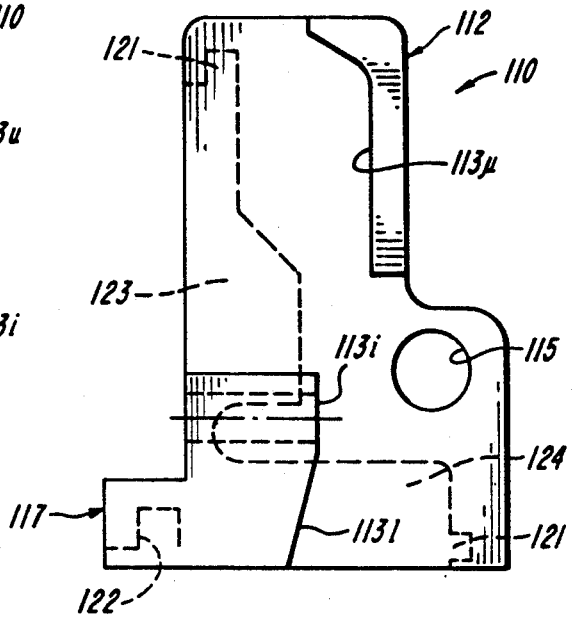

Another embodiment of connector end caps 110 according to the present invention are illustrated in FIGS. 8D, 8E. This particular embodiment may be utilized without the end positioned mounting blocks. The end cap member 112 of this embodiment is configured to receive the early mate resilient ground contact 126 depicted in FIGS. 8K, 8L. The end cap engaging means 129 for this ground contact 126 is a mating bore formed through the central portion thereof.

The end cap member 112 includes contact positioning portions 113, contact retention means 114, in this embodiment a threaded bore and corresponding retention screw (now shown), a securement bore 115 and a sealing portion 117. The end cap member 112 further includes a housing engagement portion 120 integrally formed therewith. The housing engagement portion 120 includes housing engaging shoulders 121 configured for sliding engagement into the first and second module engaging channels 70, 71 of the connector housing 60, a wedge engaging shoulder 122, and upper and lower abutment segments 123, 124.

The resilient ground contact 126 is mounted in engagement with the end cap member 112 by inserting the retention screw through the retention bore 129 and into the threaded bore 114 formed through the intermediate contact positioning portion $113_i$. The daughterboard engaging portion 128 is spaced apart from the upper contact positioning portion $113_u$.

The connector end caps 110 are secured to the connector housing 60 by sliding the engaging shoulders 121 and the wedge engaging shoulder 122 into the first and second module engaging channels 70, 71 of the connector housing 60 and the complementary module engaging member 82 of the daughterboard biasing wedge 80, respectively. Securement screws 18A are inserted through the securement bores 115 into threaded engagement circular channels 63 of the connector housing 60. The housing engagement portion 120 abuttingly engages the daughterboard biasing wedge 80 and the power contact modules 90 or the contact modules 30 to maintain same in static fixed relation with respect to one another. The upper and lower abutment segments 123, 124 of the connector end caps 110 of this embodiment engage corresponding ends of the daughterboard interactive biasing module 170 and the motherboard interactive biasing module 150, respectively, thereby ensuring that the modules are maintained in proper orientation within the contact modules 30.

Figure 8F:
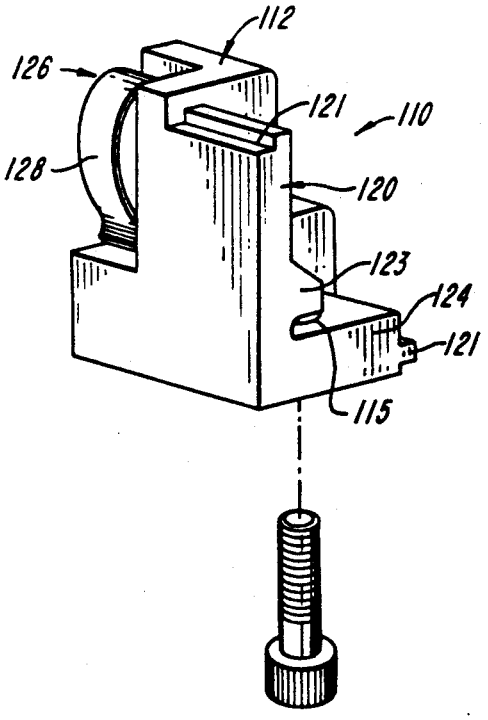
FIGS. 8F, 8G are perspective views of still another embodiment of a connector end cap according to the present invention.
Figure 8G:
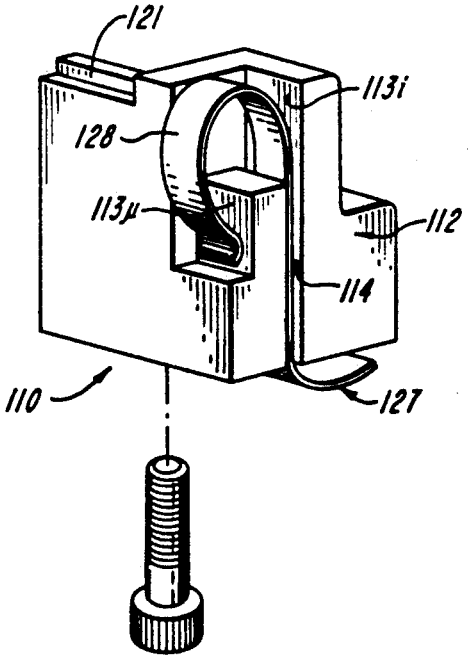

Still another embodiment of a connector end cap member 110 according to the present invention is illustrated in FIGS. 8F, 8G. The end cap member 112 of this embodiment is configured to receive an early mate resilient ground contact 126 similar to the one depicted in FIGS. 8K, 8L. The ground contact 126 for use in combination with this connector end cap member 110 need not have a mating bore 129 formed therethrough.

The end cap member 112 includes contact positioning portions 113 and contact retention means 114, in this embodiment a contact channel dimensioned to frictionally engage the intermediate portion of the resilient ground contact 126. The end cap member 112 further includes a housing engagement portion 120 having housing engaging shoulders 121 and upper and lower abutment segments 123, 124. A securement bore 115 is formed through the lower abutment segment 124.

The resilient ground contact 126 is mounted in engagement with the end cap member 112 by inserting the intermediate portion thereof into contact channel 114. The free end of the daughterboard engaging portion 128 is positioned opposite the upper contact positioning portion $113_u$. The connector end caps 110 are secured to the connector housing 60 by sliding the engaging shoulders 121 into the first and second module engaging channels 70, 71 of the connector housing 60. Securement screws 18 are inserted through from the underside of the motherboard 14 and threaded into the securement bores 115 such that this particular embodiment provides localized securement to the motherboard 14. The housing engagement portion 120 abuttingly engages the power contact modules 90 or the contact modules 30 to maintain same in static fixed relation with respect to one another. The upper and lower abutment segments 123, 124 of the connector end caps 110 of this embodiment engage corresponding ends of the daughterboard interactive biasing module 170 and the motherboard interactive biasing module 150, respectively, thereby ensuring that the modules are maintained in proper orientation within the contact modules 30.

Figure 8H:
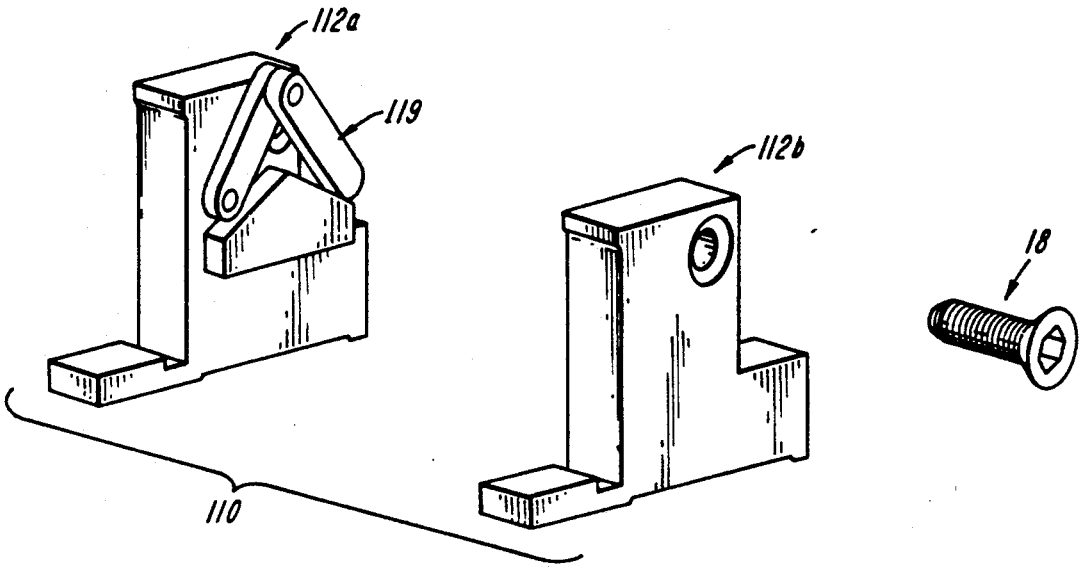
FIG. 8H is a perspective view of yet another embodiment of a connector end cap according to the present invention.
Figure 8I:
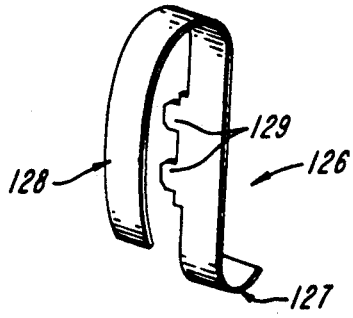
FIGS. 8I, 8J are perspective and plan views of one embodiment of a resilient ground contact according to the present invention.
Figure 8J:
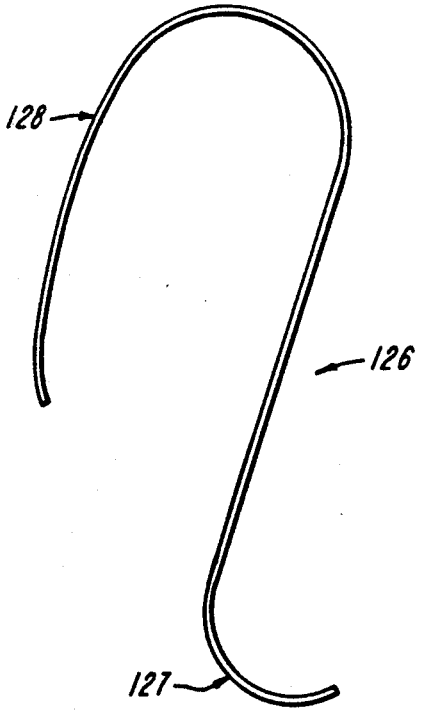
Figure 8K:
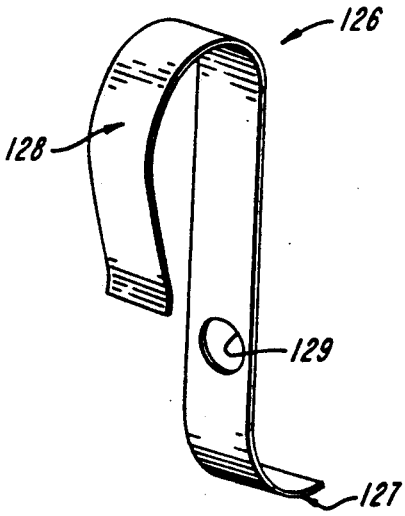
FIGS. 8K, 8L are perspective and plan views of another embodiment of a resilient ground contact according to the present invention.
Figure 8L:
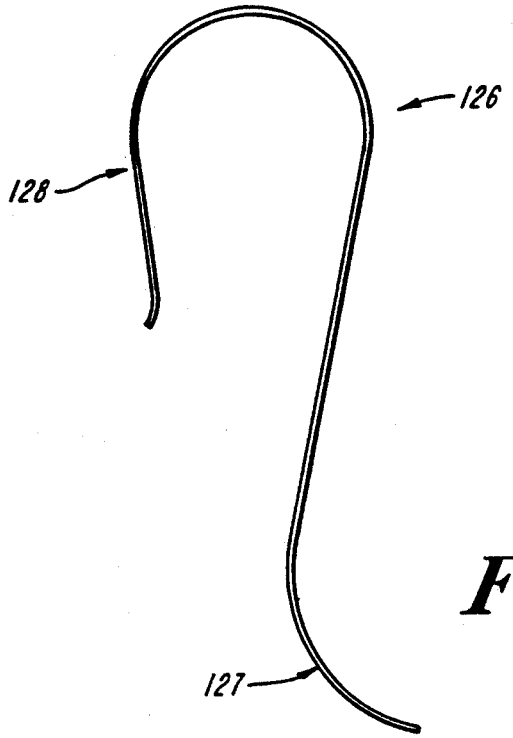

Another embodiment of a connector end cap 110 is illustrated in FIG. 8H. This embodiment includes two end cap members **112*a*, 112*b* having configurations suitable for assemblage with the other elements of the connector, e.g., contact modules 30, connector housing 60, power contact modules 90 and/or mounting blocks 190. This embodiment includes a camming means 119 that comprises a camming linkage. The camming linkage 119 interacts with the daughterboard 12 to bias the daughterboard 12 into adjacency with the contact modules 30. This embodiment of the connector end cap 110 eliminates the need for camming coaction between the camming member 130 and the connector housing 60** such that the structures thereof may be simplified.

Figure 9A:
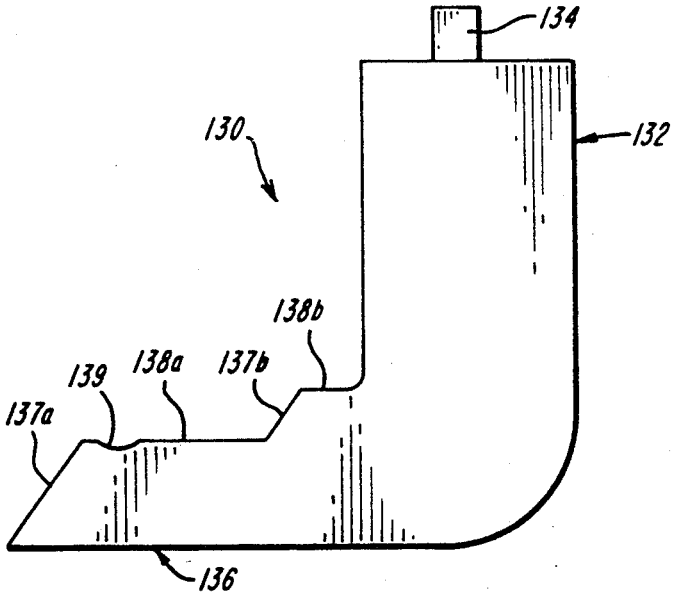
FIGS. 9A, 9B are plan views of exemplary camming members according to the present invention.
Figure 9B:
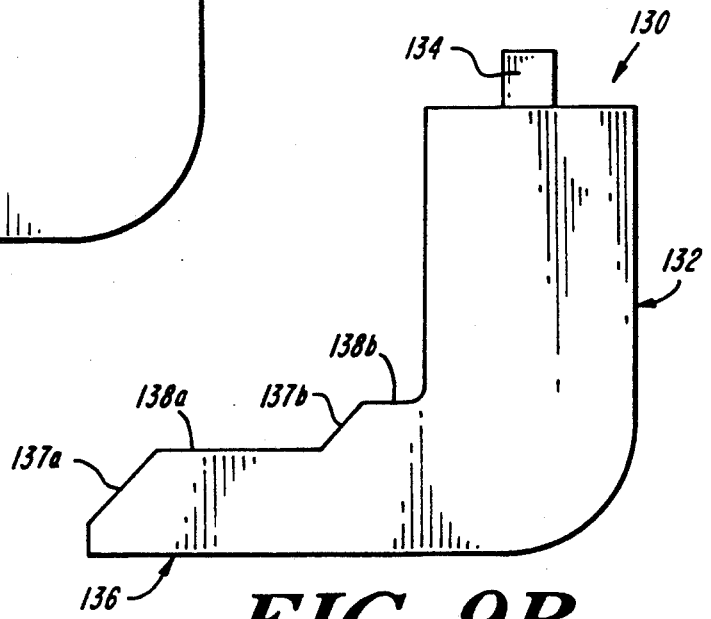

Camming members 130 according to the present invention are exemplarily illustrated in FIGS. 2A and 9A, 9B. The camming member 130 is configured to coact with the connector housing 60 of the present invention to provide a positive means for sequencing movement, during mating, of the complementary signal/ground contact pads $23_{db}$ of the daughterboard 12 into contact with the arrays $51_{db}$ of contact rivets $52_{db}$ disposed in the first planar member 32 of the contact module 30, thereby facilitating contact wipe thereof. The camming member 130 also provides proper alignment between the daughterboard 12 and the MHDB connector 10. The camming member 130 is formed as an integral member, for example by extrusion, from a structurally rigid material such as aluminum (6061-T6) or plastic and is readily formed in any convenient length, depending upon the number of contact modules 30, power modules 90 and/or mounting blocks 190 comprising the MHDB connector 10.

The camming member 130 includes a securing segment 132 and a camming segment 136. The securing segment 132 has threaded bores 133 formed in the end face thereof. Securing screws 17 are inserted through securing bores $26_s$ in the daughterboard 12 and into the threaded bores 133 to rigidly secure the camming member 130 to the daughterboard 12. The securing segment 132 may include alignment pins 134 to facilitate aligning the camming member 130 for securement with the daughterboard 12. The securing segment also includes a keying channel 135 configured to receive the alignment member 67 of the connector housing 60 to align the daughterboard 12 for mating with the MHDB connector 10.

The camming segment 136 is configured for camming and engaging coaction with the connector housing 60. The internal surface of the camming segment 136 includes first and second tapered camming surfaces **137*a*, 137*b* and first and second planar engaging surfaces 138*a*, 138*b*. During mating the first and second tapered camming surfaces 137*a*, 137*b* coact with camming member 74 and the upper edge of the connector housing 60, respectively, to bias the daughterboard signal/ground contact pads $23_{db}$ into corresponding elements of the daughterboard array $51_{db}$ of contact rivets $52_{db}$. The first and second planar engaging surfaces 138*a*, 138*b* mechanically engage the camming member 74 and the connector housing 60 to complete the mating sequence. The embodiment of FIG. 9A further includes a recess 139 for nesting of the camming member 74**.

Figure 10C:
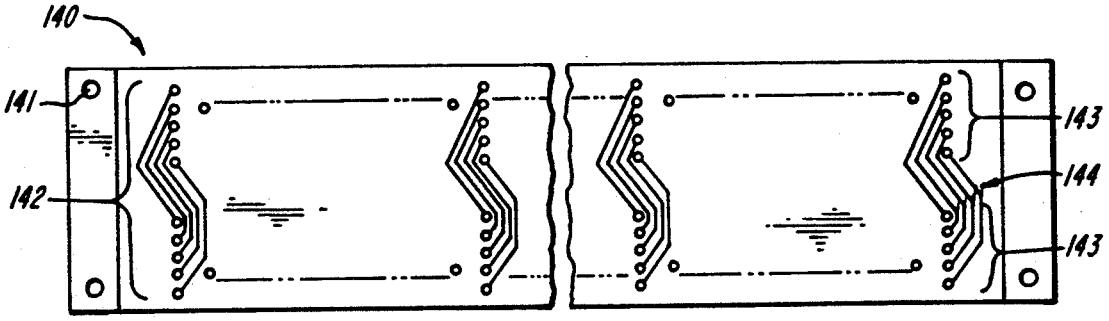

The flexible film 140 embodiments exemplarily illustrated in FIGS. 10A, 10B, 10C are fabricated from a resilient dielectric material. Heat-resistant polymers such as polyimides are a representative dielectric having excellent electrical properties and which are readily formable into thin, bendable flexible films. A preferred embodiment of the flexible film 140 is depicted in FIGS. 10A, 10B. The preferred embodiment exemplarily illustrated has a width of about 1.04 inches and a length of about 2.50 inches. FIG. 10C illustrates an alternative embodiment of the flexible film 140 according to the present invention.

The flexible film 140 has registration holes 141 formed through the ends thereof to facilitate registration with the corresponding contact module 30. A conductive matrix 142 is formed on one major surface of the flexible film 140 and includes first and second spaced-apart arrays of contact pads 143 electrically interconnected by a plurality of conductive traces 144. The exemplarily illustrated conductive traces 144 have widths of about 0.005 inches and interspacings of about 0.005 inches. The finished conductive matrix 142 will have an impedance of about 50 ohms.

Metallic ground strips 146 are formed along opposite longitudinal edges of the flexible film 140 embodiment illustrated in FIG. 10A. Each metallic ground strip 146 includes a plurality of plated-through holes 147. The conductive matrix 142 and the metallic ground strips 146 are formed from electrically conductive material such as electrolytic plated copper by conventional photolithographic techniques.

A conductive ground plane 148 is formed on the other major surface of the flexible film 140 as illustrated in FIG. 10B. The plurality of plated-through holes 147 provide the electrical interconnection between the conductive ground plane 148 and the conductive ground strips 146. The ground plane 148 is formed from electrically conductive material such as electrolytic plated copper by conventional plating techniques.

An alternative embodiment of the flexible film 140 according to the present invention is illustrated in FIG. 10C. The embodiment of FIG. 10C is similar to the embodiment of FIGS. 10A, 10B but does not include conductive ground strips and the plurality of plated-through holes. Also, the arrays of conductive pads 143 comprise five rows of contact pads whereas the arrays of conductive pads 143 of the embodiment of FIGS. 10A, 10B comprises four rows of contact pads.

The conductive matrix 142 provides the electrical interconnect between the signal/ground contact pads $23_{mb}$, $23_{db}$ of the motherboard 14 and daughterboard 12, respectively, via the contacts 52 of the contact module 30. The geometric pattern of the conductive matrix 142 corresponds to the contact arrays $51_{mb}$, $51_{db}$ of the contact modules 30 as described hereinabove. For the embodiment of FIG. 10A, the four rows of contact pads of the arrays 143 electrically interface with the signal contact elements 52 of the contact modules 30. The ground strips 146 electrically interface with the ground contact elements 52 of the contact modules 30. For the embodiment of FIG. 10C, the outermost rows, i.e., those proximal the longitudinal edge, of contact pads of the arrays 143 electrically interface with ground contact elements 52 of the contact modules 30.

Figure 13A:
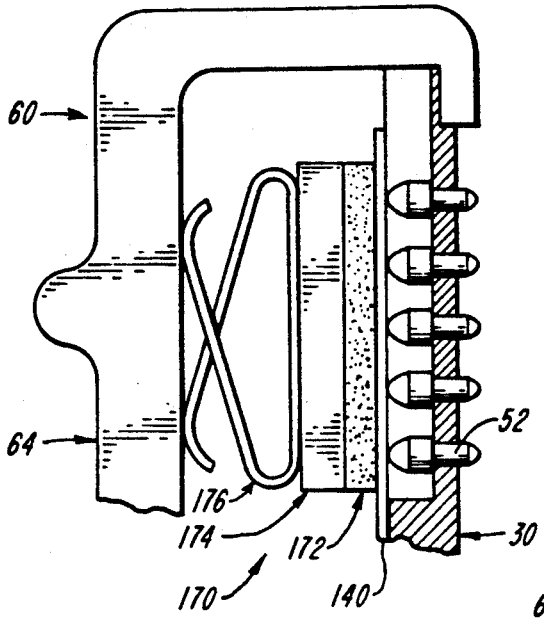
FIGS. 13A, 13B are plan views of daughterboard interactive biasing modules according to the present invention.
Figure 13B:
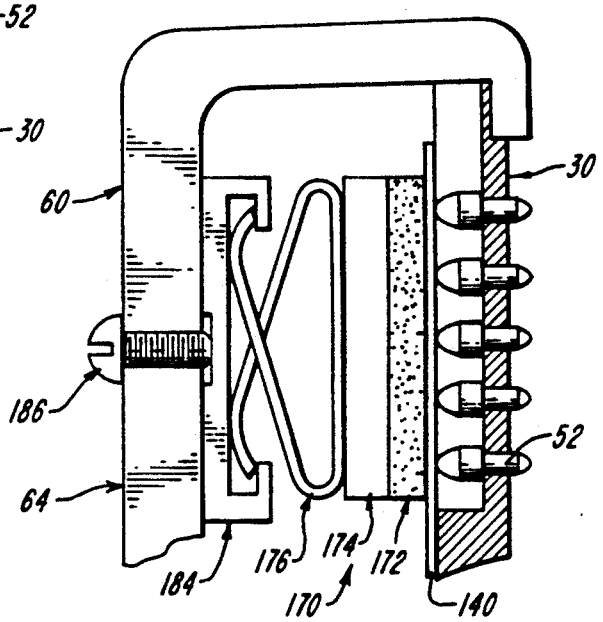
Figure 11:
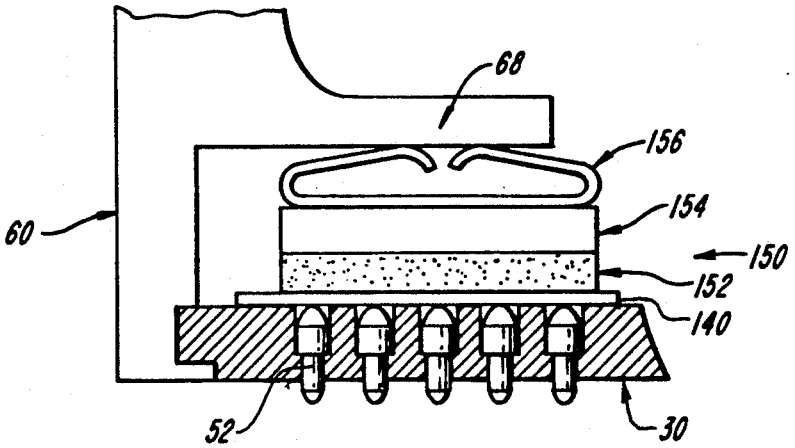
FIG. 11 is a plan view of a motherboard interactive biasing module according to the present invention.
Figure 12C:
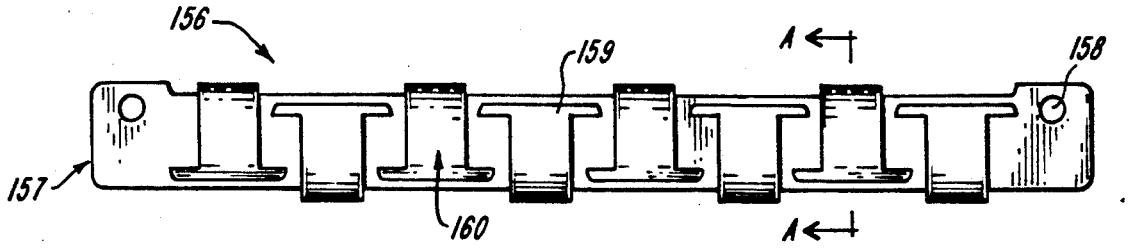
FIGS. 12A, 12B, 12C, 12D are cross-sectional, plan and partial perspective views, respectively, of one embodiment of a motherboard biasing spring for the biasing module of FIG. 11.
Figure 12B:
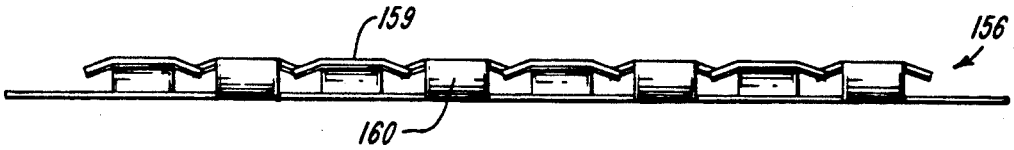
Figure 12A:
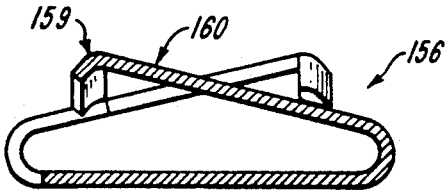
Figure 12D:
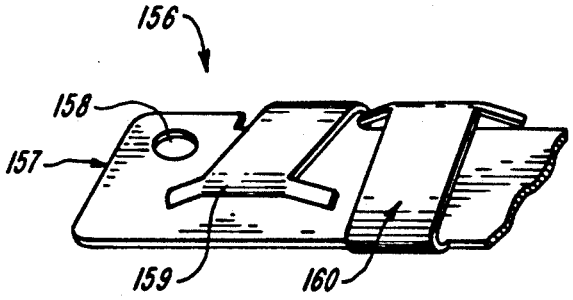
Figure 12G:
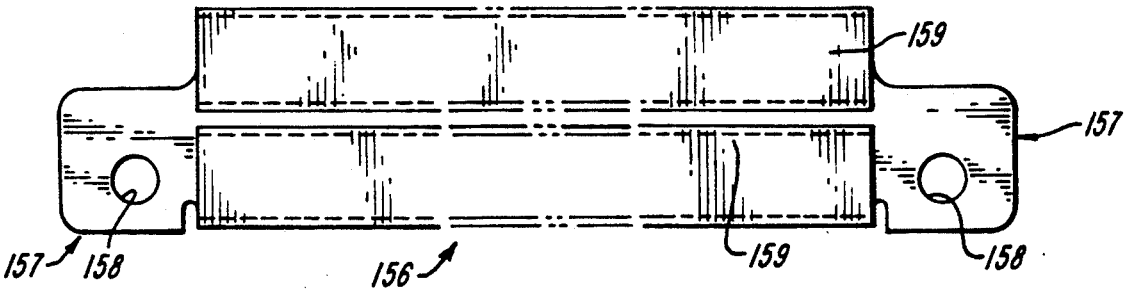
FIGS. 12E, 12F, 12G are plan views of another embodiment of a motherboard biasing spring for the biasing module of FIG. 11.
Figure 12F:
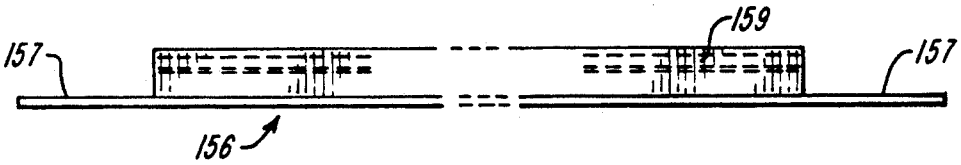
Figure 12E:
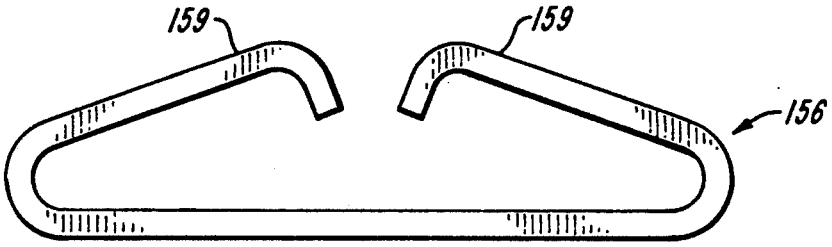
Figure 14C:
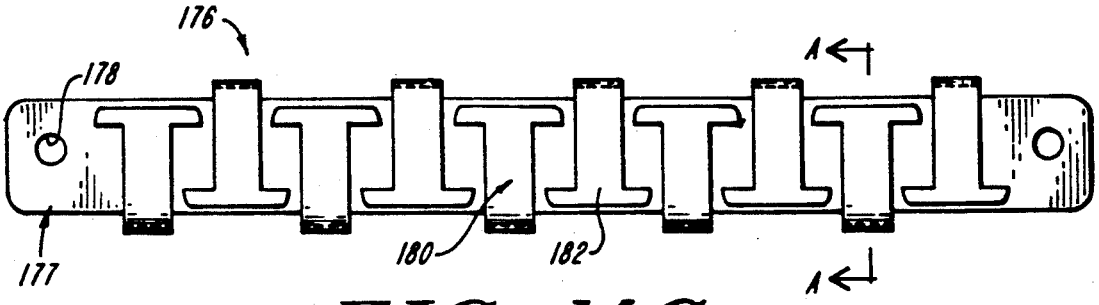
FIGS. 14A, 14B, 14C, 14D are cross-sectional, plan and partial perspective views, respectively of a daughterboard biasing spring for the biasing modules of FIGS. 13A, 13B.
Figure 14B:
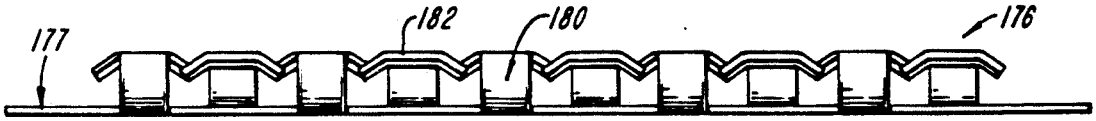
Figure 14A:
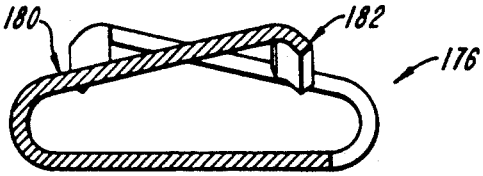
Figure 14D:
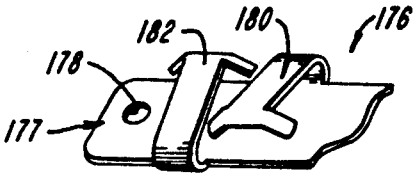
Figure 14G:
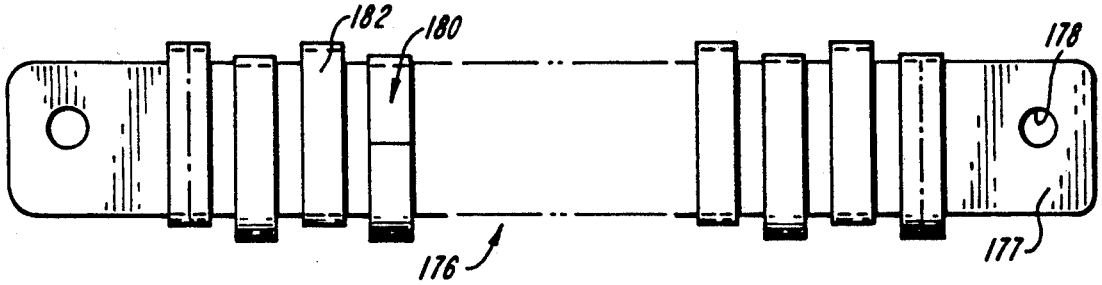
FIGS. 14E, 14F, 14G are plan views of another embodiment of a daughterboard biasing spring for the biasing module of FIG. 11.
Figure 14F:
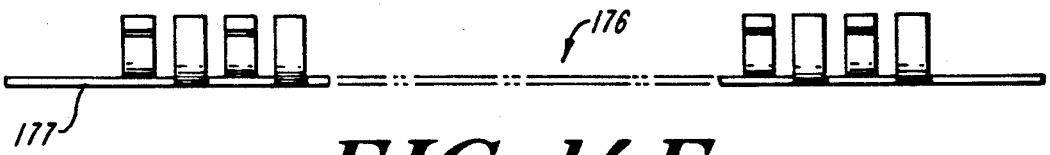
Figure 14E:
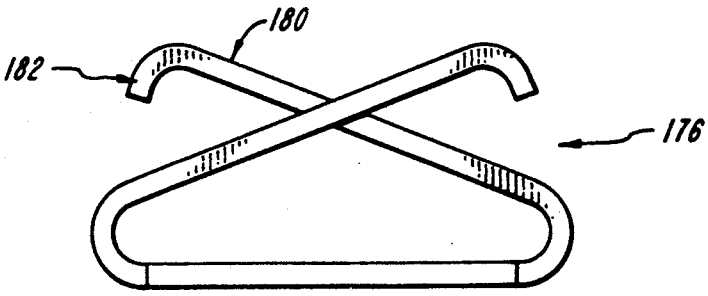

An exemplary motherboard interactive biasing module 150 and an exemplary daughterboard interactive biasing module 170 according to the present invention are illustrated in FIGS. 11 and 13A, 13B, respectively. The interactive biasing moduling 150, 170 provide uniform contact force distribution between the flexible film 140 and the first and second arrays $51_{mb}$, $51_{db}$ of contact rivets 52, respectively. The interactive biasing modules 150, 170 also provide displacement tolerance relief for the first and second arrays $51_{mb}$, $51_{db}$ of contact rivets 52 disposed in each contact module 30, respectively.

The motherboard biasing module 150 includes a resilient pad 152, a distribution plate 154 and a motherboard force generating spring 156. The resilient pad 152 is formed from a elastomeric material such as silicone rubber that provides point-to-point compression variances. The resilient pad 152 abuts the ground plane side of the flexible film 140 and provides displacement tolerance relief for the corresponding contacts $52_{mb}$ of the contact module 30. The resilient pad 152 abuts the distribution plate 154. The distribution plate 154 is formed from a structurally rigid material such as stainless steel (type 302-304), aluminum or high impact plastic and provides an even distribution of the biasing force generated by the motherboard force generating spring 156 over the respective interconnect regions.

Several exemplary embodiments of the motherboard biasing spring 156 according to the present invention are illustrated in FIGS. 12A, 12B, 12C, 12D and 12E, 12F, 12G. The motherboard biasing spring 156 is a structure formed from a resilient material such as stainless steel (carpenter custom 455) that provides the force to bias the flexible film 140 into mechanical and electrical engagement with the contacts 52. The motherboard force generating spring 156 includes mounting tabs 157 having holes 158 formed therethrough for securing the spring 156 to the distribution plate 154. The force generating spring 156 embodiment of FIGS. 12A, 12B, 12C, 12D comprises a plurality of alternating curved leaves 160 having end portions 159. The force generating spring 156 embodiment of FIGS. 12E, 12F, 12G comprises spaced-apart elongated curved segments having end portions 159. The end portions 159 mechanically engage the platform member 68 to provide the biasing force thereof.

One embodiment of the daughterboard interactive biasing module 170 according to the present invention is illustrated in FIG. 13A. The biasing module 170 includes a resilient pad 172, a distribution plate 174 and a daughterboard force generating spring 176. The resilient pad 172 is formed from a elastomeric material such as silicone rubber that provides point-to-point compression variances. The resilient pad 172 abuts the ground plane side of the flexible film 140 and provides displacement tolerance relief for the corresponding contacts $52_{db}$ of the contact module 30. The resilient pad 172 abuts the distribution plate 174. The distribution plate 174 is formed from a structurally rigid material such as stainless steel (type 302-304), aluminum or high impact plastic and provides an even distribution of the biasing force generated by the daughterboard force generating spring 176 over the interconnect region.

Another embodiment of the daughterboard interactive biasing module 170 is illustrated in FIG. 13B. The interactive biasing module 170 is as described hereinabove and further includes an adjustment plate 184 and an adjusting means 186. The adjustment plate 184 is formed from a structurally rigid material such as stainless steel (type 302-304), aluminum or high impact plastic and is configured to retain the end portions 182 of the daughterboard force generating spring 176. The adjustment plate 184 abuts against the second sidewall 64. The adjusting means 186 illustrated is a set screw disposed through the connector housing 60 to mechanically engage the adjustment plate 184. The adjustment plate 184 and the adjustment means 186 in combination provides a means of adjusting the biasing force exerted in the contact region to compensate for variations in tolerances in manufacturing and mating.

Several exemplary embodiments of the daughterboard force generating spring 176 are depicted in FIGS.

14A, 14B, 14C, 14D and 14E, 14F, 14G. The daughterboard force generating spring 176 is a discontinuous structure formed from a resilient material such as stainless steel (carpenter custom 455) that provides the force to bias the flexible film 140 into mechanical and electrical engagement with the contacts 52. The daughterboard force generating spring 176 includes mounting tabs 177 having holes 178 formed therethrough for securing the spring 176 to the distribution plate 174. The force generating spring 176 includes a plurality of alternating curved leaves 180 having end portions 182 which mechanically engage the second sidewall 64 or the adjustment plate 184 to provide the biasing force thereof.

Various embodiments of mounting blocks 190 according to the present invention are exemplarily illustrated in FIGS. 2A, 2B and FIGS. 15A, 15B, 15C. The mounting block 190 may be integrally formed from a rigid material such as aluminum (6061-T6), which may be finished with teflon impregnated TUFRAM, or high impact plastic by any of the various fabrication techniques, such as extrusion, and is readily formed to a predetermined configuration. The mounting blocks 190 may be used as an intermediate spacing/securing element (FIG. 15C) or may be used as an end positioned securing element (FIGS. 15A, 15B) in combination with connector end caps 110. FIG. 2A illustrates the latter use while FIG. 2B illustrates the use of the mounting block 190 as an intermediate spacing means and as a means for securing the MHDB connector 10 to the motherboard 14.

The intermediate mounting block 190 includes housing engaging shoulders 192 configured for sliding engagement with the first and second module engaging channels 70, 71 of the connector housing 60, a wedge engaging member 194 configured to engage the complementary contact module engaging member 82 and abutment surfaces 195, 196 to engage abutting elements comprising the MHDB connector 10, e.g., contact modules 30, power contact modules 90. The mounting block 190 has a mounting bore 198 formed therethrough and configured to receive a securing screw 18 inserted through securing hole $26_s$ to fasten the mounting block 190 to the motherboard 14.

Figure 15A:
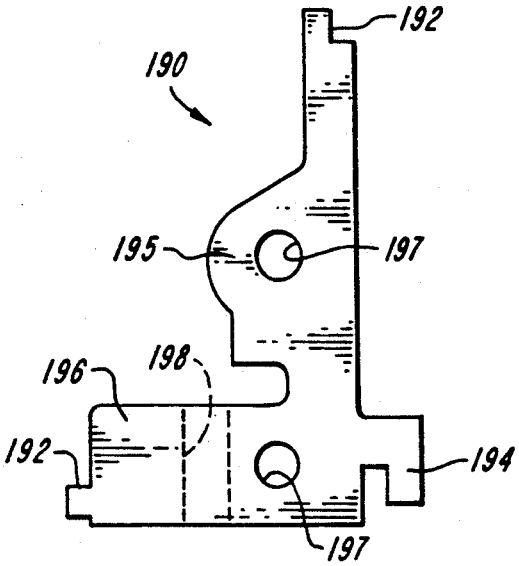
FIGS. 15A, 15B, 15C are plan views of various embodiments of mounting blocks according to the present invention.
Figure 15B:
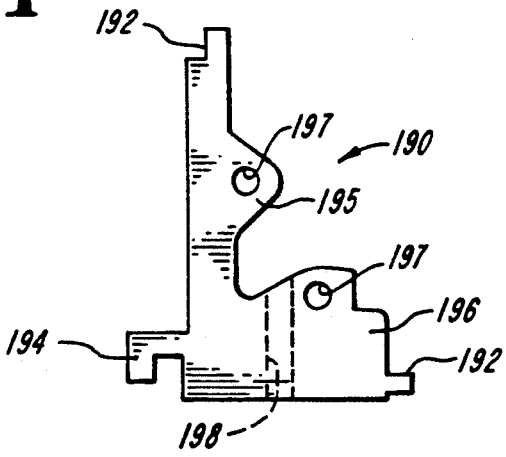
Figure 15C:
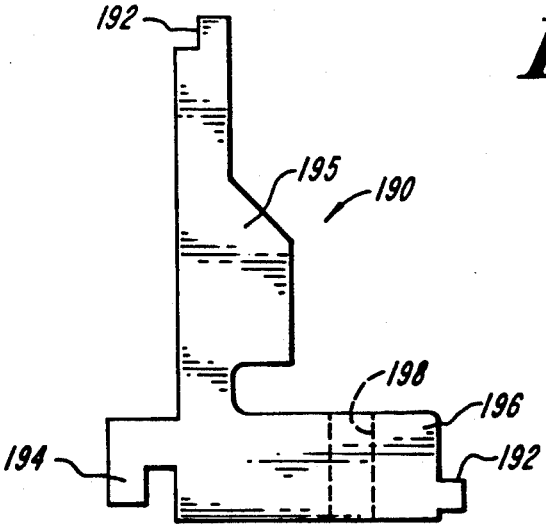

The embodiments illustrated in FIGS. 15A, 15B further include stepped bores 197. The stepped bores 197 are configured for snap-engagement reception of the segmented engagement prongs 116 of the connector end caps 110. The embodiment of FIG. 15C may be utilized in combination with a resilient spring, similar to that illustrated in FIGS. 8K, 8L. The resilient spring coacts with the daughterboard 12 to exert a supplemental biasing force thereagainst for sequenced mating of the daughterboard 12 to the MHDB connector 10.

Exemplarily, the MHDB connector 10 is assembled in combination with the motherboard 14 by first aligning each contact module 30, preloaded with the arrays $51_{mb}$ and $51_{db}$ of rivet contacts 52, thereon by inserting alignment pins 16 that are fitted into the alignment bores 46 of each contact module 30 through holes $26_a$ on the motherboard 14. The flexible film 140 is disposed in registration with each contact module 30 and the motherboard and daughterboard interactive biasing modules 150, 170 disposed in combination with each contact module 30.

The connector housing 60 is assembled in combination with the contact module 30 by sliding the first and second module engaging shoulders 70, 71 onto the corresponding shoulders 40, 50 of each contact module 30. Power contact modules 90, as required, may be assembled in combination with the connector housing 60 by sliding the housing engaging shoulders 94 of each module 90 into the corresponding first and second module engaging channels 70, 71 of the housing 60. Mounting blocks 190, if utilized as intermediate spacing/securing elements, may be assembled in combination with the connector housing 60 by sliding the housing engaging shoulders 192 of each block 190 into the corresponding first and second module engaging channels 70, 71 of the housing 60.

The daughterboard biasing wedge 80 is assembled in combination with the connector by sliding the complementary contact module engaging portion 82 into the wedge engaging member 42 of the contact module 30 and the wedge engaging member 194 of any intermediate mounting blocks 190.

The MHDB connector 10 is sealed by mating the connector end caps 110 to aforedescribed assemblage. End positioned mounting blocks 190 may be utilized as required by the particular connector end cap 110 configuration. The MHDB connector 10 is secured to the motherboard 14 by inserting securing screws 18 through the motherboard 14 into the securement bores 115 of the connector end caps 110 or the mounting bores 198 of end positioned mounting blocks 190.

Figure 16C:
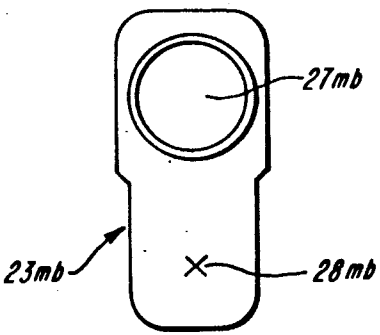
Figure 16B:
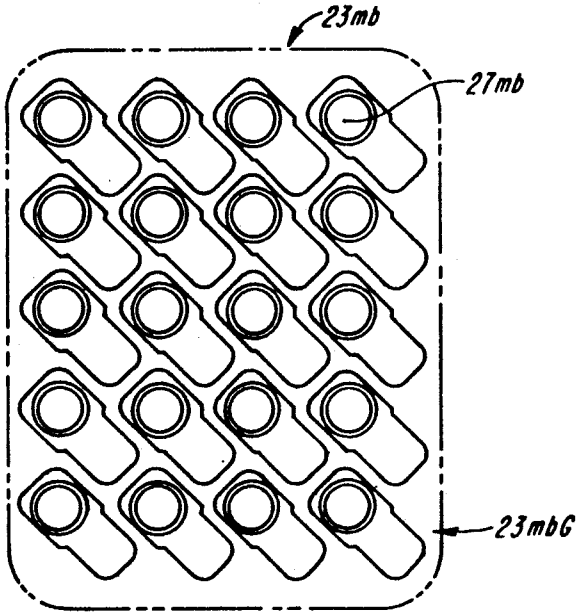

With the MHDB connector 10 assembled as discussed hereinabove, each motherboard interactive biasing module 150 exerts a biasing force against the corresponding region of the respective flexible film 140 to bias the array 143 of contact pads thereof into mechanical and electrical engagement with corresponding array $51_{mb}$ of rivet contacts $52_{mb}$. Each rivet contact $52_{mb}$ is thereby biased into mechanical and electrical engagement with a corresponding motherboard signal/ground contact pad $23_{mb}$. As illustrated in FIG. 16C, each rivet contact $52_{mb}$ engages the corresponding motherboard signal/ground contact pad $23_{mb}$ at a defined contact zone $28_{mb}$.

Mating of the daughterboard 12 (with the camming member 130 secured thereto) is effected by pressing the daughterboard 12 downwardly onto the MHDB connector 10. The resilient ground contacts 126 of the connector end caps, and the resilient spring of any intermediate mounting blocks 190, initially interact with the daughterboard 12 to bias the daughterboard 12 away from the MHDB connector 10, thereby preventing premature engagement of the daughterboard signal/ground contact pads $23_{db}$ with the array $51_{db}$ of contact rivets $52_{db}$ of corresponding contact modules 30. The resilient ground contacts 126 also provide early mating between the discrete ground pads $24_{mb}$ of the motherboard 14 and the discrete ground pads $24_{db}$ of the daughterboard 12. As the daughterboard 12 is progressively moved downwardly into the MHDB connector 10, each resilient power contact 105 interacts with the daughterboard 12 to supplement the "away from" biasing force provided by the resilient ground contacts 126.

Figure 17C:
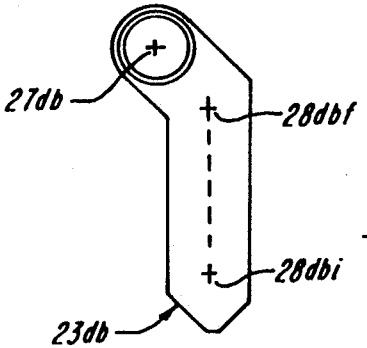
Figure 17B:
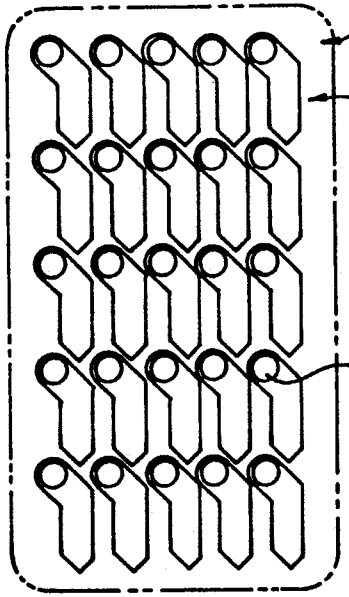

Further downward displacement of the daughterboard 12 causes a coaction between the complementary camming structure 74 and the connector housing 60 and the tapered camming surfaces **137*a*, 137*b*, respectively, of the camming segment 136 of the camming member 130. The camming coaction is sufficient to overcome the biasing forces exerted by the resilient elements, thereby displacing the daughterboard 12 into the MHDB connector 10. This camming coaction also prevent relative rotational movement between the daughterboard 12 and the MHDB connector 10. The displacement causes the daughterboard signal/ground contact pads $23_{db}$ to initially engage corresponding elements of the array $51_{db}$ of rivet contacts $52_{db}$ at an initial contact zone $28_{dbi}$, as illustrated in FIG. 17C**.

A final very small downward displacement of the daughterboard 12 completes the mating process. The small downward displacement causes each rivet contact $52_{db}$ to translate along the surface of the corresponding daughterboard contact pad $23_{db}$ to a final contact zone $28_{dbf}$ as illustrated in FIG. 17C. The translation of each rivet contact $52_{db}$ between the initial contact zone $28_{dbi}$ and the final contact zone $28_{dbf}$ provides the wiping action that ensures good electrical interconnection between the respective contact elements.

In the mated state, the leading edge of the daughterboard 12 is engaged with daughterboard engaging surface 86 of the biasing wedge 80. Concomitantly, the planar engaging surfaces 138*a*, 138*b* (and/or the recess 139) mechanically engage the connector housing 60. These engagements prevent the daughterboard 12 from creeping away from the MHDB connector 10, thereby ensuring a positive electrical interconnection therebetween.

The MHDB connector of the present invention provides the capability of electrically interconnecting printed circuit boards having a high density of input/output contact interconnects. The modular elements of the MHDB connector are of relatively straightforward design, thereby facilitating the ease and cost of manufacturing by conventional methods. The MHDB connector is independent of printed circuit board thicknesses and variations in tolerances. Moreover, the modular elements are easily resized, reconfigured, and/or interchanged to facilitate use thereof with printed circuit boards of varying dimensions and/or varying contact pad densities.

The MHDB connector of the present invention does not require a separate and/or complex camming mechanism. The camming elements of the MHDB connector are readily formed as integral elements of the connector housing or the connector end caps. The camming elements of the MHDB connector provide a wiping action between interconnecting conductive elements, provide a sequential mating capability, and require only a low insertion force to effect mating between printed circuit boards. The inherent simplicity and operation of the camming elements greatly increases the reliability of the MHDB connector.

Each contact module is assembled with preloaded rivet contacts and readily assembled in combination with the flexible film and the corresponding interactive biasing modules, thereby facilitating assemblage thereof. The preloaded rivet contacts are free-floating and coact orthogonally with the contact interconnects formed on the flexible film. Orthogonal coaction substantially eliminates the possibility of any erosion and/or abrasion damage of the contact interconnects of the flexible film, thereby maintaining signal path integrity and impedance matching. The conductive matrix and the ground plane are readily formed as continuous circuit paths on the flexible film to ensure precise impedance matching for printed circuit board interconnects. These features provide enhanced electrical performance for the MHDB connector.

A variety of modifications and variations of the present invention are possible in light of the above teachings. For example, the connector end cap configuration may include an upper cap member that is secured to the camming member mounted to the daughterboard and which interfaces with the upper surface of the connector end cap as illustrated in FIG. 2A. Alternatively, the upper cap member may include a pin member that is inserted into a corresponding hole in the camming member.

Figure 18A:
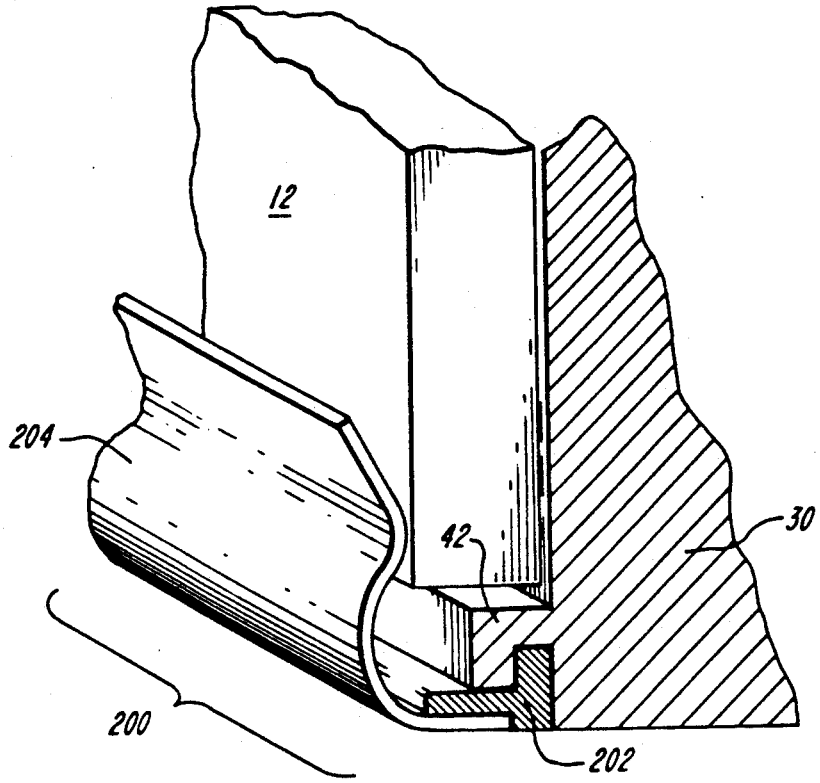
FIGS. 18A, 18B are partial perspective views of alternative daughterboard camming mechanisms according to the present invention.
Figure 18B:
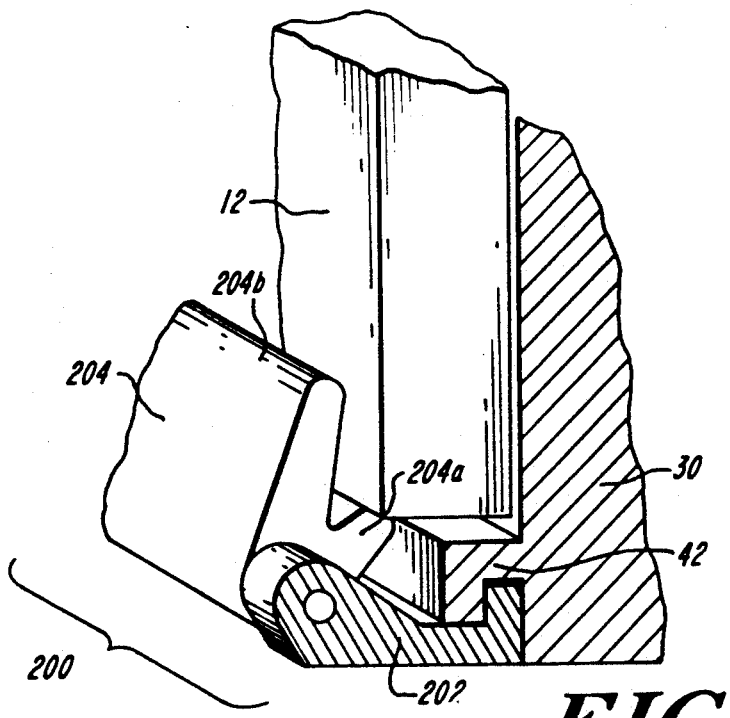

Alternatively, the daughterboard biasing wedge 80 as described hereinabove may be replaced by the daughterboard camming subassemblies 200 exemplarily illustrated in FIGS. 18A, 18B. The daughterboard camming subassemblies 200 include means 202 for mechanically engaging the wedge engaging member 42 of the contact module 30 and means 204 for displacing the daughterboard 12 into the contact module 30. For the embodiment of FIG. 18A, the displacing means 204 is an elongated resilient member that biases the daughterboard 12 into the contact module 30. For the embodiment of FIG. 18B, the displacing means 204 is curved, rigid member having first and second ends 204*a*, 204*b* and rotatably coupled to the engaging means 202. The first end 204*a* engages an edge of the daughterboard 12 to cause rotation of the curved, rigid member 204 such that the second end 204*b* engages one major surface of the daughterboard 12 to displace it into the contact module 30.

Figure 19:
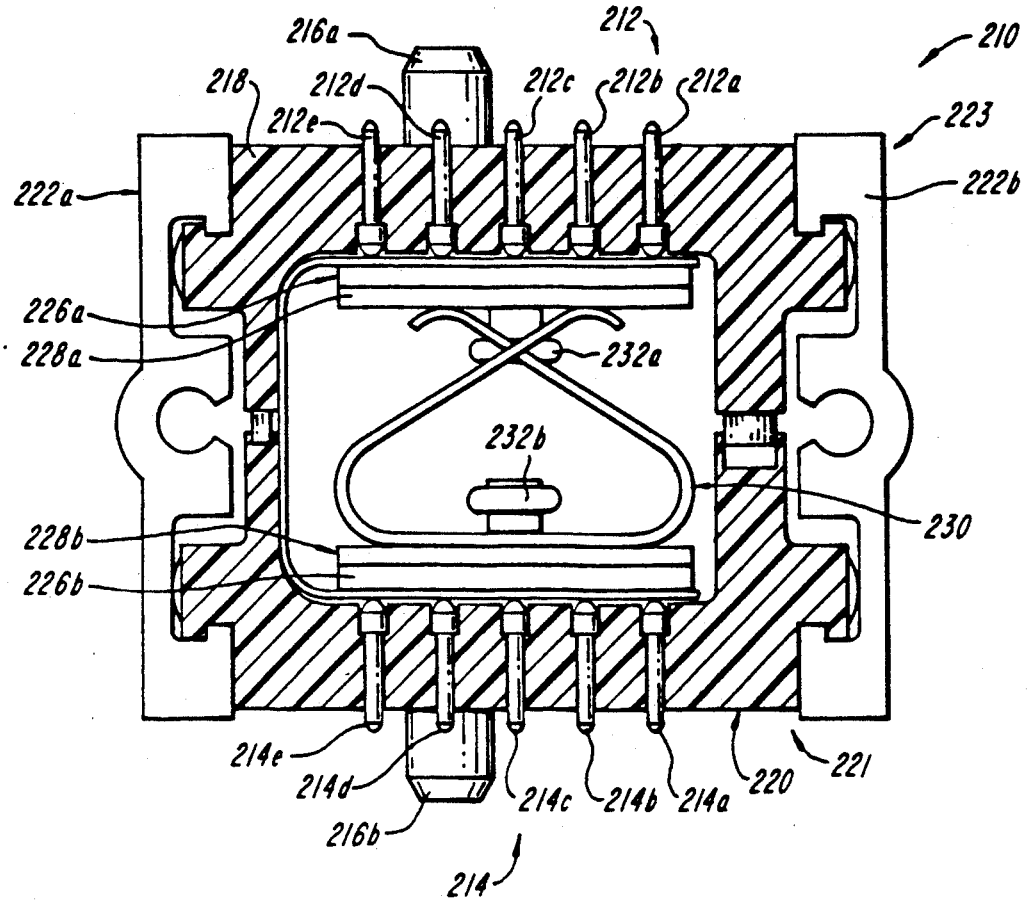
FIG. 19 is a transverse section of an alternate embodiment of a high density backplane connector.

Referring now to FIG. 19 an alternate embodiment of an MHDB connector 210 for providing contact between two printed circuit boards (not shown) disposed in two different but parallel planes is shown to include an upper contact module 218 locked to a lower contact module 220 to provide an overall contact module 221. Side housings 222*a* and 222*b* are disposed on opposite ends of the contact module 221 to provide a connector housing 223. The connector 210 further includes first and second orientation pins 216*a* and 216*b* to provide a means for aligning the MHDB connector 210 with printed circuit boards (not shown) which will be coupled thereto. A first array of contacts 212, here five contacts 212*a*–212*e*, are disposed on a first side of the contact module 221. A second array of contacts 214, here five contacts 214*a*–214*e*, are disposed on a second opposite side of the contact module 221 in a plane parallel to the plane in which said first array of contacts 212 lies.

The MHDB connector 210 further includes a matched impedance film 224 disposed in contact with the first contact array 212 and the second array 214. The matched impedance film 224 is provided having a plurality of strip conductors (not shown) and pads (not shown) disposed thereon to provide electrical connections between predetermined ones of the contacts 212*a*–212*e* and the contacts 214*a*–214*e*.

The MHDB connector 210 further includes a first resilient pad 226*a* disposed behind the matched impedance film 224 in a region proximate to the first contact array 212. A second resilient pad 226*b* is disposed behind the matched impedance film 224 in a region proximate to the second contact array 214. Distribution plates 228*a* and 228*b* are disposed over the resilient pads 226*a* and 226*b*, respectively. A normal force spring 230 is disposed between and in contact with each of the force distribution plates 228*a* and 228*b* as shown.

The connector 210 further includes alignment posts 232*a* and 232*b* disposed proximate to the force distribution plates 328*a* and 328*b*, respectively, to align the spring 230. Thus, MHBD connector 210 having the first contact array 212 disposed on the first side of the contact module 221 and the second contact array 214 disposed on the second opposite side of the contact module 221 along a plane parallel to the first contact array 212 provides a means for connecting two printed wiring circuit boards disposed in parallel planes.

Figure 20:
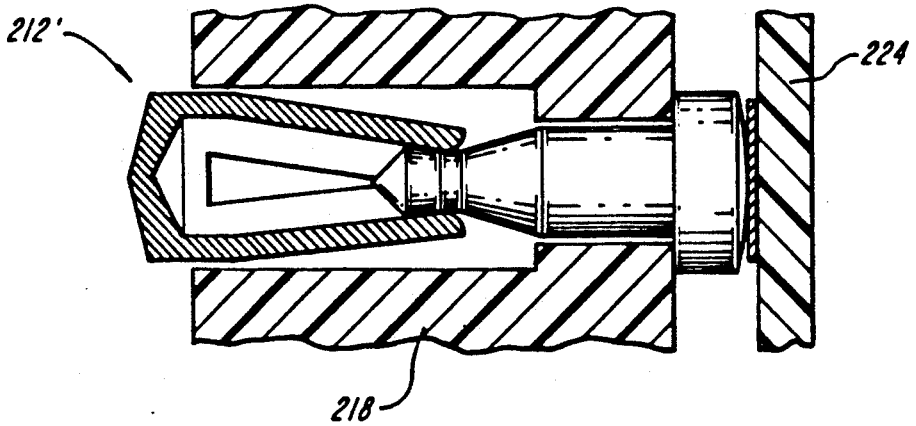
FIG. 20 is a view of a contact.

It will be appreciated that the contact arrays 212, 214 can include various other types of contacts, including "spring loaded" type contacts, such as that disclosed in U.S. Pat. No. 4,838,801 issued Jun. 13, 1989 and assigned to the assignee of the present invention which is incorporated herein by reference. As shown in FIG. 20, in which like elements of the connector of FIG. 19 are provided having like reference designations, a contact 212' includes a first electrically conductive member disposed in the opening of the housing with a first end of the first electrically conductive member having a ramp surface and a second end of the first electrically conductive member disposed through a first end of the opening of the housing and extending beyond a first surface of the housing. A second electrically conductive member is disposed over the first end of the first electrically conductive member with the second electrically conductive member having spring means cooperative with the ramp surfaces of the first electrically conductive member.

It is therefore to be understood that, within the scope of the appended claims, the present invention may be practiced otherwise than as specifically described hereinabove.

What is claimed:

1. A connector comprising:

a contact module comprising, a housing having first and second sides;

a first array of contacts disposed on the first side of said housing along a first plane of said contact module; and a second array of contacts disposed on the second side of said housing along a second plane of said contact module with the second plane being parallel to the first plane in which said first array of contacts are disposed;

a matched impedance film disposed in contact with said first and second arrays of contacts said matched impedance film comprising, a dielectric sheet;

first and second arrays of contact pads disposed on said dielectric sheet, said first and second arrays of contact pads corresponding to said first and second arrays of contacts, respectively, of said contact module; and means for electrically interconnecting said first and second arrays of contact pads; and at least one interactive biasing module including at least one resilient pad, at least one plate in cooperation with said at least one resilient pad and at least one force generating means interacting with said matched impedance film for providing substantially uniform contact force distribution and displacement tolerance relief for said first and second arrays of contacts of said contact module.

2. The connector of claim 1 wherein said interactive biasing module comprises:

resilient pad disposed over a first surface of said matched impedance film proximate to said first and second arrays of contact pads of said matched impedance film, wherein said resilient pad provides displacement tolerance relief for said first and second arrays of contacts of said contact module;

a first plate, disposed over a first surface of said resilient pad, wherein said plate provides substantially uniform distribution of contact forces over a first one of said first and second arrays of contacts of said contact module;

a second plate disposed over a first surface of said resilient pad, wherein said plate provides substantially uniform distribution of contact forces over a second one of said first and second arrays of contacts of said contact module; and force generating means engaging said first and second plates and providing contact forces promoting electrical coupling between said first and second arrays of contact pads of said matched impedance film and said first and second arrays of contacts of said contact module.

3. The connector of claim 2 wherein:

at least one of said first and second arrays of contacts comprise:

a plurality of contacts wherein each of said contacts are disposed in a corresponding one of a like plurality of openings in said housing and each of said contacts comprise:

a first electrically conductive member disposed in the corresponding opening of said housing with a first end of said first electrically conductive member having a ramp surface and a second end of said first electrically conductive member disposed through a first end of the opening of said housing and extending beyond a first surface of said housing; and a second electrically conductive member disposed over the first end of said first electrically conductive member the second electrically conductive member having spring means cooperative with the ramp surface of said first electrically conductive member.

4. A modified high density backplane connector comprising:

a contact module comprising:

means for aligning said modified high density backplane connector with first and second printed circuit boards;

a first array of contacts disposed along a first plane of said contact module to electrically couple predetermined ones of signal and ground contact pads disposed on the first printed circuit board; and a second array of contacts disposed along a second plane of said contact module means said second plane being parallel to said first plane with said second array of contacts electrically coupled to predetermined ones of ground and signal contact pads disposed on the second printed circuit board;

a matched impedance film disposed in contact with said first and second contact arrays said matched impedance film comprising:

first and second arrays of contact pads corresponding to said first and second arrays of contacts, respectively, of said contact module means; and means for electrically interconnecting said first and second arrays of contact pads;

at least one interactive biasing module means interacting with said matched impedance film for providing uniform contact force distribution and displacement tolerance relief for said first and second arrays of contacts of said contact module means, said interactive biasing means comprising:

resilient pad means engaging said matched impedance film proximate to said first and second arrays of contact pads, respectively, of said conductive matrix for providing displacement tolerance relief for said first and second arrays of contacts of said contact module means;

plate means engaging said resilient pad means for providing substantially uniform distribution of contact forces against said first and second arrays of contacts of said contact module means; and force generating spring means engaging said plate means for providing contact forces and for facilitating electrical coupling between said first and second arrays of contact pads of said matched impedance film and said first and second arrays of contact pads of said contact module means.

5. A modified high density backplane connector for mating and electrically interconnecting first and second printed circuit boards having predetermined geometric arrays of signal, ground and contact pads, comprising:

contact module means for aligning said modified high density backplane connector with the second printed circuit board, said contact module means including a first array of contacts disposed in a first plane and a second array of contacts disposed in a second plane parallel to said first plane with said first and second array of contacts corresponding to the predetermined geometric arrays of signal and ground contact pads of the first and second printed circuit boards, respectively, and said second array of contacts being electrically interconnected to the predetermined geometric array of ground and signal contact pads of the second printed circuit board;

flexible film means for providing a conductive matrix including first and second arrays of contact pads corresponding to said first and second arrays of contacts, respectively, of said contact module means and means for electrically interconnecting said first and second arrays of contact pads of said conductive matrix, said flexible film means interacting with said contact module means to provide electrical interconnection between said first and second arrays of contacts of said contact module means by means of said conductive matrix;

at least one interactive biasing module means interacting with said flexible film means for providing substantially uniform contact force distribution and displacement tolerance relief for said first and second arrays of contacts of said contact module means, said interactive biasing means comprising:

resilient pad means abutting said flexible film opposite said first and second arrays of contact pads, respectively, of said conductive matrix for providing displacement tolerance relief for said first and second arrays of contacts of said contact module means;

plate means abutting said resilient pad means for providing substantially uniform distribution of contact forces over said first and second arrays of contacts of said contact module means; and force generating spring means engaging said plate means for providing said contact forces to bias said first and second arrays of contact pads of said conductive matrix into electrical engagement with said first and second arrays of contact pads of said contact module means.

6. The connector of claim 3 wherein said force generating means comprise a spring having a first surface disposed against a first one of said first and second plates and a second surface disposed against a second one of said first and second plates.

* * * * *

UNITED STATES PATENT AND TRADEMARK OFFICE

CERTIFICATE OF CORRECTION

PATENT NO. : 5,205,739
DATED : April 27, 1993
INVENTOR(S) : Cheryne Malo, et al.

It is certified that error appears in the above-indentified patent and that said Letters Patent is hereby corrected as shown below:

Column 3, line 56, "modules" should read --modules.--

Column 11, line 43, "pad $22_{md}$" should read --pad $22_{mb}$--.

Signed and Sealed this

Third Day of May, 1994

Bruce Lehman

*Attest:*

BRUCE LEHMAN

*Attesting Officer*

*Commissioner of Patents and Trademarks*